US007354332B2

(12) United States Patent
Surana et al.

(10) Patent No.: US 7,354,332 B2
(45) Date of Patent: Apr. 8, 2008

(54) TECHNIQUE FOR PROCESS-QUALIFYING A SEMICONDUCTOR MANUFACTURING TOOL USING METROLOGY DATA

(75) Inventors: Rahul Surana, Fremont, CA (US); Ajoy Zutshi, Fremont, CA (US)

(73) Assignee: Applied Materials, Inc., Santa Clara, CA (US)

( * ) Notice: Subject to any disclaimer, the term of this patent is extended or adjusted under 35 U.S.C. 154(b) by 151 days.

(21) Appl. No.: 10/809,906

(22) Filed: Mar. 26, 2004

(65) Prior Publication Data

US 2005/0032459 A1 Feb. 10, 2005

Related U.S. Application Data

(60) Provisional application No. 60/491,974, filed on Aug. 4, 2003.

(51) Int. Cl.
*B49D 1/00* (2006.01)

(52) U.S. Cl. ..... 451/5; 451/6; 451/8; 451/9; 451/10; 451/41; 451/287; 451/286

(58) Field of Classification Search ..... 451/5, 451/6, 8, 9, 10, 41, 287, 258
See application file for complete search history.

(56) References Cited

U.S. PATENT DOCUMENTS

| | | | |
|---|---|---|---|
| 3,205,485 | A | 9/1965 | Noltingk |
| 3,229,198 | A | 1/1966 | Libby |
| 3,767,900 | A | 10/1973 | Chao et al. |
| 3,920,965 | A | 11/1975 | Sohrwardy |
| 4,000,458 | A | 12/1976 | Miller et al. |
| 4,207,520 | A | 6/1980 | Flora et al. |

(Continued)

FOREIGN PATENT DOCUMENTS

| | | |
|---|---|---|
| CA | 2050247 | 8/1991 |

(Continued)

OTHER PUBLICATIONS

U.S. Appl. No. 09/363,966, filed Jul. 29, 1999, Arackaparambil et al., Computer Integrated Manufacturing Techniques.

(Continued)

*Primary Examiner*—Joseph J. Hail, III
*Assistant Examiner*—Shantese L. McDonald
(74) *Attorney, Agent, or Firm*—Blakely Sokoloff Taylor & Zafman

(57) ABSTRACT

A technique of the present invention utilizes qualification characteristics from a single wafer for qualifying a semiconductor manufacturing tool. Generally speaking, the technique commences with the processing of a wafer by the manufacturing tool. During processing, one or more qualification characteristics required to properly qualify the tool are measured using an in situ sensor or metrology device. Subsequently, the manufacturing tool is qualified by adjusting one or more parameters of a recipe in accordance with the qualification characteristics measured from the wafer to target one or more manufacturing tool specifications. In some embodiments, the tool to be qualified includes a bulk removal polishing platen, a copper clearing platen and a barrier removal polishing platen. In these cases, the technique involves transferring a wafer to each of the bulk removal polishing platen, copper clearing platen and barrier removal polishing platen, where qualification characteristics are measured from the wafer during processing. These platens are subsequently qualified by adjusting one or more parameters of a recipe associated with each platen in accordance with the qualification characteristics measured from the wafer, to target one or more platen specifications.

39 Claims, 9 Drawing Sheets

U.S. PATENT DOCUMENTS

| | | | |
|---|---|---|---|
| 4,209,744 | A | 6/1980 | Gerasimov et al. |
| 4,302,721 | A | 11/1981 | Urbanek et al. |
| 4,368,510 | A | 1/1983 | Anderson |
| 4,609,870 | A | 9/1986 | Lale et al. |
| 4,616,308 | A | 10/1986 | Morshedi et al. |
| 4,663,703 | A | 5/1987 | Axelby et al. |
| 4,698,766 | A | 10/1987 | Entwistle et al. |
| 4,750,141 | A | 6/1988 | Judell et al. |
| 4,755,753 | A | 7/1988 | Chern |
| 4,757,259 | A | 7/1988 | Charpentier |
| 4,796,194 | A | 1/1989 | Atherton |
| 4,901,218 | A | 2/1990 | Cornwell |
| 4,938,600 | A | 7/1990 | Into |
| 4,957,605 | A | 9/1990 | Hurwitt et al. |
| 4,967,381 | A | 10/1990 | Lane et al. |
| 5,089,970 | A | 2/1992 | Lee et al. |
| 5,108,570 | A | 4/1992 | Wang |
| 5,208,765 | A | 5/1993 | Turnbull |
| 5,220,517 | A | 6/1993 | Sierk et al. |
| 5,226,118 | A | 7/1993 | Baker et al. |
| 5,231,585 | A | 7/1993 | Kobayashi et al. |
| 5,236,868 | A | 8/1993 | Nulman |
| 5,240,552 | A | 8/1993 | Yu et al. |
| 5,260,868 | A | 11/1993 | Gupta et al. |
| 5,270,222 | A | 12/1993 | Moslehi |
| 5,283,141 | A | 2/1994 | Yoon et al. |
| 5,295,242 | A | 3/1994 | Mashruwala et al. |
| 5,309,221 | A | 5/1994 | Fischer et al. |
| 5,329,463 | A | 7/1994 | Sierk et al. |
| 5,338,630 | A | 8/1994 | Yoon et al. |
| 5,347,446 | A | 9/1994 | Iino et al. |
| 5,367,624 | A | 11/1994 | Cooper |
| 5,369,544 | A | 11/1994 | Mastrangelo |
| 5,375,064 | A | 12/1994 | Bollinger |
| 5,398,336 | A | 3/1995 | Tantry et al. |
| 5,402,367 | A | 3/1995 | Sullivan et al. |
| 5,408,405 | A | 4/1995 | Mozumder et al. |
| 5,410,473 | A | 4/1995 | Kaneko et al. |
| 5,420,796 | A | 5/1995 | Weling et al. |
| 5,427,878 | A | 6/1995 | Corliss |
| 5,444,837 | A | 8/1995 | Bomans et al. |
| 5,469,361 | A | 11/1995 | Moyne |
| 5,485,082 | A | 1/1996 | Wisspeintner et al. |
| 5,490,097 | A | 2/1996 | Swenson et al. |
| 5,495,417 | A | 2/1996 | Fuduka et al. |
| 5,497,316 | A | 3/1996 | Sierk et al. |
| 5,497,381 | A | 3/1996 | O'Donoghue et al. |
| 5,503,707 | A | 4/1996 | Maung et al. |
| 5,508,947 | A | 4/1996 | Sierk et al. |
| 5,511,005 | A | 4/1996 | Abbe et al. |
| 5,519,605 | A | 5/1996 | Cawlfield |
| 5,525,808 | A | 6/1996 | Irie et al. |
| 5,526,293 | A | 6/1996 | Mozumder et al. |
| 5,534,289 | A | 7/1996 | Bilder et al. |
| 5,541,510 | A | 7/1996 | Danielson |
| 5,546,312 | A | 8/1996 | Mozumder et al. |
| 5,553,195 | A | 9/1996 | Meijer |
| 5,586,039 | A | 12/1996 | Hirsch et al. |
| 5,599,423 | A | 2/1997 | Parker et al. |
| 5,602,492 | A | 2/1997 | Cresswell et al. |
| 5,603,707 | A | 2/1997 | Trombetta et al. |
| 5,617,023 | A | 4/1997 | Skalski |
| 5,627,083 | A | 5/1997 | Tounai |
| 5,629,216 | A | 5/1997 | Wijaranakula et al. |
| 5,642,296 | A | 6/1997 | Saxena |
| 5,646,870 | A | 7/1997 | Krivokapic et al. |
| 5,649,169 | A | 7/1997 | Berezin et al. |
| 5,654,903 | A | 8/1997 | Reitman et al. |
| 5,655,951 | A | 8/1997 | Meikle et al. |
| 5,657,254 | A | 8/1997 | Sierk et al. |
| 5,661,669 | A | 8/1997 | Mozumder et al. |
| 5,663,797 | A | 9/1997 | Sandhu |
| 5,664,987 | A | 9/1997 | Renteln |
| 5,665,199 | A | 9/1997 | Sahota et al. |
| 5,665,214 | A | 9/1997 | Iturralde |
| 5,666,297 | A | 9/1997 | Britt et al. |
| 5,667,424 | A | 9/1997 | Pan |
| 5,674,787 | A | 10/1997 | Zhao et al. |
| 5,694,325 | A | 12/1997 | Fukuda et al. |
| 5,695,810 | A | 12/1997 | Dubin et al. |
| 5,698,989 | A | 12/1997 | Nulman |
| 5,719,495 | A | 2/1998 | Moslehi |
| 5,719,796 | A | 2/1998 | Chen |
| 5,735,055 | A | 4/1998 | Hochbein et al. |
| 5,740,429 | A | 4/1998 | Wang et al. |
| 5,751,582 | A | 5/1998 | Saxena et al. |
| 5,754,297 | A | 5/1998 | Nulman |
| 5,761,064 | A | 6/1998 | La et al. |
| 5,761,065 | A | 6/1998 | Kittler et al. |
| 5,764,543 | A | 6/1998 | Kennedy |
| 5,777,901 | A | 7/1998 | Berezin et al. |
| 5,787,021 | A | 7/1998 | Samaha |
| 5,787,269 | A | 7/1998 | Hyodo |
| 5,808,303 | A | 9/1998 | Schlagheck et al. |
| 5,812,407 | A | 9/1998 | Sato et al. |
| 5,823,854 | A | 10/1998 | Chen |
| 5,824,599 | A | 10/1998 | Schacham-Diamand et al. |
| 5,825,356 | A | 10/1998 | Habib et al. |
| 5,825,913 | A | 10/1998 | Rostami et al. |
| 5,828,778 | A | 10/1998 | Hagi et al. |
| 5,831,851 | A | 11/1998 | Eastburn et al. |
| 5,832,224 | A | 11/1998 | Fehskens et al. |
| 5,838,595 | A | 11/1998 | Sullivan et al. |
| 5,838,951 | A | 11/1998 | Song |
| 5,844,554 | A | 12/1998 | Geller et al. |
| 5,857,258 | A | 1/1999 | Penzes et al. |
| 5,859,777 | A | 1/1999 | Yokoyama et al. |
| 5,859,964 | A | 1/1999 | Wang et al. |
| 5,859,975 | A | 1/1999 | Brewer et al. |
| 5,862,054 | A | 1/1999 | Li |
| 5,863,807 | A | 1/1999 | Jang et al. |
| 5,867,389 | A | 2/1999 | Hamada et al. |
| 5,870,306 | A | 2/1999 | Harada |
| 5,871,805 | A | 2/1999 | Lemelson |
| 5,883,437 | A | 3/1999 | Maruyama et al. |
| 5,889,991 | A | 3/1999 | Consolatti et al. |
| 5,901,313 | A | 5/1999 | Wolfe et al. |
| 5,903,455 | A | 5/1999 | Sharpe, Jr. et al. |
| 5,910,011 | A | 6/1999 | Cruse |
| 5,910,846 | A | 6/1999 | Sandhu |
| 5,912,678 | A | 6/1999 | Saxena et al. |
| 5,916,016 | A | 6/1999 | Bothra |
| 5,923,553 | A | 7/1999 | Yi |
| 5,926,690 | A | 7/1999 | Toprac et al. |
| 5,930,138 | A | 7/1999 | Lin et al. |
| 5,940,300 | A | 8/1999 | Ozaki |
| 5,943,237 | A | 8/1999 | Van Boxem |
| 5,943,550 | A | 8/1999 | Fulford, Jr. et al. |
| 5,960,185 | A | 9/1999 | Nguyen |
| 5,960,214 | A | 9/1999 | Sharpe, Jr. et al. |
| 5,961,369 | A | 10/1999 | Bartels et al. |
| 5,963,881 | A | 10/1999 | Kahn et al. |
| 5,975,994 | A | 11/1999 | Sandhu et al. |
| 5,978,751 | A | 11/1999 | Pence et al. |
| 5,982,920 | A | 11/1999 | Tobin, Jr. et al. |
| 6,002,989 | A | 12/1999 | Shiba et al. |
| 6,012,048 | A | 1/2000 | Gustin et al. |
| 6,017,771 | A | 1/2000 | Yang et al. |
| 6,036,349 | A | 3/2000 | Gombar |
| 6,037,664 | A | 3/2000 | Zhao et al. |
| 6,041,263 | A | 3/2000 | Boston et al. |
| 6,041,270 | A | 3/2000 | Steffan et al. |
| 6,054,379 | A | 4/2000 | Yau et al. |
| 6,059,636 | A | 5/2000 | Inaba et al. |

6,064,759 A 5/2000 Buckley et al.
6,072,313 A 6/2000 Li et al.
6,074,443 A 6/2000 Venkatesh et al.
6,077,412 A 6/2000 Ting et al.
6,078,845 A 6/2000 Friedman
6,094,688 A 7/2000 Mellen-Garnett et al.
6,096,649 A 8/2000 Jang
6,097,887 A 8/2000 Hardikar et al.
6,100,195 A 8/2000 Chan et al.
6,108,092 A 8/2000 Sandhu
6,111,634 A 8/2000 Pecen et al.
6,112,130 A 8/2000 Fukuda et al.
6,113,462 A 9/2000 Yang
6,114,238 A 9/2000 Liao
6,127,263 A 10/2000 Parikh
6,128,016 A 10/2000 Coelho et al.
6,136,163 A 10/2000 Cheung et al.
6,141,660 A 10/2000 Bach et al.
6,143,646 A 11/2000 Wetzel
6,148,099 A 11/2000 Lee et al.
6,148,239 A 11/2000 Funk et al.
6,148,246 A 11/2000 Kawazome
6,150,270 A 11/2000 Matsuda et al.
6,157,864 A 12/2000 Schwenke et al.
6,159,075 A 12/2000 Zhang
6,159,644 A 12/2000 Satoh et al.
6,161,054 A 12/2000 Rosenthal et al.
6,169,931 B1 1/2001 Runnels
6,172,756 B1 1/2001 Chalmers et al.
6,173,240 B1 1/2001 Sepulveda et al.
6,175,777 B1 1/2001 Kim
6,178,390 B1 1/2001 Jun
6,181,013 B1 1/2001 Liu et al.
6,183,345 B1 2/2001 Kamono et al.
6,185,324 B1 2/2001 Ishihara et al.
6,191,864 B1 2/2001 Sandhu
6,192,291 B1 2/2001 Kwon
6,197,604 B1 3/2001 Miller et al.
6,204,165 B1 3/2001 Ghoshal
6,210,983 B1 4/2001 Atchison et al.
6,211,094 B1 4/2001 Jun et al.
6,212,961 B1 4/2001 Dvir
6,214,734 B1 4/2001 Bothra et al.
6,217,412 B1 4/2001 Campbell et al.
6,219,711 B1 4/2001 Chari
6,222,936 B1 4/2001 Phan et al.
6,226,563 B1 5/2001 Lim
6,226,792 B1 5/2001 Goiffon et al.
6,228,280 B1 5/2001 Li et al.
6,230,069 B1 5/2001 Campbell et al.
6,236,903 B1 5/2001 Kim et al.
6,237,050 B1 5/2001 Kim et al.
6,240,330 B1 5/2001 Kurtzberg et al.
6,240,331 B1 5/2001 Yun
6,245,581 B1 6/2001 Bonser et al.
6,246,972 B1 6/2001 Klimasauskas
6,248,602 B1 6/2001 Bode et al.
6,249,712 B1 6/2001 Boiquaye
6,252,412 B1 6/2001 Talbot et al.
6,253,366 B1 6/2001 Mutschler, III
6,259,160 B1 7/2001 Lopatin et al.
6,263,255 B1 7/2001 Tan et al.
6,268,270 B1 7/2001 Scheid et al.
6,271,670 B1 8/2001 Caffey
6,276,989 B1 8/2001 Campbell et al.
6,277,014 B1 8/2001 Chen et al.
6,278,899 B1 8/2001 Piche et al.
6,280,289 B1 8/2001 Wiswesser et al.
6,281,127 B1 8/2001 Shue
6,284,622 B1 9/2001 Campbell et al.
6,287,879 B1 9/2001 Gonzales et al.
6,290,572 B1 9/2001 Hofmann
6,291,367 B1 9/2001 Kelkar
6,292,708 B1 9/2001 Allen et al.
6,298,274 B1 10/2001 Inoue
6,298,470 B1 10/2001 Breiner et al.
6,303,395 B1 10/2001 Nulman
6,304,999 B1 10/2001 Toprac et al.
6,307,628 B1 10/2001 Lu et al.
6,314,379 B1 11/2001 Hu et al.
6,317,643 B1 11/2001 Dmochowski
6,320,655 B1 11/2001 Matsushita et al.
6,324,481 B1 11/2001 Atchison et al.
6,334,807 B1 1/2002 Lebel et al.
6,336,841 B1 1/2002 Chang
6,339,727 B1 1/2002 Ladd
6,340,602 B1 1/2002 Johnson et al.
6,345,288 B1 2/2002 Reed et al.
6,345,315 B1 2/2002 Mishra
6,346,426 B1 2/2002 Toprac et al.
6,355,559 B1 3/2002 Havemann et al.
6,360,133 B1 3/2002 Campbell et al.
6,360,184 B1 3/2002 Jacquez
6,363,294 B1 3/2002 Coronel et al.
6,366,934 B1 4/2002 Cheng et al.
6,368,879 B1 4/2002 Toprac
6,368,883 B1 4/2002 Bode et al.
6,368,884 B1 4/2002 Goodwin et al.
6,379,980 B1 4/2002 Toprac
6,381,564 B1 4/2002 Davis et al.
6,388,253 B1 5/2002 Su
6,389,491 B1 5/2002 Jacobson et al.
6,391,780 B1 5/2002 Shih et al.
6,395,152 B1 5/2002 Wang
6,397,114 B1 5/2002 Eryurek et al.
6,400,162 B1 6/2002 Mallory et al.
6,405,096 B1 6/2002 Toprac et al.
6,405,144 B1 6/2002 Toprac et al.
6,417,014 B1 7/2002 Lam et al.
6,427,093 B1 7/2002 Toprac
6,432,728 B1 8/2002 Tai et al.
6,435,952 B1 8/2002 Boyd et al.
6,438,438 B1 8/2002 Takagi et al.
6,440,295 B1 8/2002 Wang
6,442,496 B1 8/2002 Pasadyn et al.
6,449,524 B1 9/2002 Miller et al.
6,455,415 B1 9/2002 Lopatin et al.
6,455,937 B1 9/2002 Cunningham
6,465,263 B1 10/2002 Coss, Jr. et al.
6,470,230 B1 10/2002 Toprac et al.
6,479,902 B1 11/2002 Lopatin et al.
6,479,990 B2 11/2002 Mednikov et al.
6,482,660 B2 11/2002 Conchieri et al.
6,484,064 B1 11/2002 Campbell
6,486,492 B1 11/2002 Su
6,492,281 B1 12/2002 Song et al.
6,495,452 B1 12/2002 Shih
6,503,839 B2 1/2003 Gonzales et al.
6,515,368 B1 2/2003 Lopatin et al.
6,517,413 B1 2/2003 Hu et al.
6,517,414 B1 2/2003 Tobin et al.
6,528,409 B1 3/2003 Lopatin et al.
6,529,789 B1 3/2003 Campbell et al.
6,532,555 B1 3/2003 Miller et al.
6,534,328 B1 * 3/2003 Hewett et al. ..... 438/8
6,535,783 B1 3/2003 Miller et al.
6,537,912 B1 3/2003 Agarwal
6,540,591 B1 4/2003 Pasadyn et al.
6,541,401 B1 4/2003 Herner et al.
6,546,508 B1 4/2003 Sonderman et al.
6,556,881 B1 4/2003 Miller
6,560,504 B1 5/2003 Goodwin et al.
6,563,308 B2 5/2003 Nagano et al.
6,567,717 B2 5/2003 Krivokapic et al.
6,580,958 B1 6/2003 Takano
6,587,744 B1 7/2003 Stoddard et al.

| | | | | |
|---|---|---|---|---|
| 6,590,179 | B2 | 7/2003 | Tanaka et al. | |
| 6,604,012 | B1 | 8/2003 | Cho et al. | |
| 6,605,549 | B2 | 8/2003 | Leu et al. | |
| 6,607,976 | B2 | 8/2003 | Chen et al. | |
| 6,609,946 | B1 | 8/2003 | Tran | |
| 6,616,513 | B1 | 9/2003 | Osterheld | |
| 6,618,692 | B2 | 9/2003 | Takahashi et al. | |
| 6,624,075 | B1 | 9/2003 | Lopatin et al. | |
| 6,625,497 | B2 | 9/2003 | Fairbairn et al. | |
| 6,629,879 | B1 * | 10/2003 | Kim et al. | 451/57 |
| 6,630,741 | B1 | 10/2003 | Lopatin et al. | |
| 6,640,151 | B1 | 10/2003 | Somekh et al. | |
| 6,652,355 | B2 | 11/2003 | Wiswesser et al. | |
| 6,660,633 | B1 | 12/2003 | Lopatin et al. | |
| 6,678,570 | B1 | 1/2004 | Pasadyn et al. | |
| 6,708,074 | B1 | 3/2004 | Chi et al. | |
| 6,708,075 | B2 | 3/2004 | Sonderman et al. | |
| 6,725,402 | B1 | 4/2004 | Coss, Jr. et al. | |
| 6,728,587 | B2 | 4/2004 | Goldman et al. | |
| 6,735,492 | B2 | 5/2004 | Conrad et al. | |
| 6,751,518 | B1 | 6/2004 | Sonderman et al. | |
| 6,774,998 | B1 | 8/2004 | Wright et al. | |
| 6,830,504 | B1 * | 12/2004 | Chen et al. | 451/57 |
| 6,869,332 | B2 * | 3/2005 | Redeker et al. | 451/6 |
| 2001/0001755 | A1 | 5/2001 | Sandhu et al. | |
| 2001/0003084 | A1 | 6/2001 | Finarov | |
| 2001/0006873 | A1 | 7/2001 | Moore | |
| 2001/0030366 | A1 | 10/2001 | Nakano et al. | |
| 2001/0039462 | A1 | 11/2001 | Mendez et al. | |
| 2001/0040997 | A1 | 11/2001 | Tsap et al. | |
| 2001/0042690 | A1 | 11/2001 | Talieh | |
| 2001/0044667 | A1 | 11/2001 | Nakano et al. | |
| 2002/0032499 | A1 | 3/2002 | Wilson et al. | |
| 2002/0058460 | A1 | 5/2002 | Lee et al. | |
| 2002/0070126 | A1 | 6/2002 | Sato et al. | |
| 2002/0077031 | A1 | 6/2002 | Johannson et al. | |
| 2002/0081951 | A1 | 6/2002 | Boyd et al. | |
| 2002/0089676 | A1 | 7/2002 | Pecen et al. | |
| 2002/0102853 | A1 | 8/2002 | Li et al. | |
| 2002/0107599 | A1 | 8/2002 | Patel et al. | |
| 2002/0107604 | A1 | 8/2002 | Riley et al. | |
| 2002/0113039 | A1 | 8/2002 | Mok et al. | |
| 2002/0127950 | A1 | 9/2002 | Hirose et al. | |
| 2002/0128805 | A1 | 9/2002 | Goldman et al. | |
| 2002/0149359 | A1 | 10/2002 | Crouzen et al. | |
| 2002/0165636 | A1 | 11/2002 | Hasan | |
| 2002/0183986 | A1 | 12/2002 | Stewart et al. | |
| 2002/0185658 | A1 | 12/2002 | Inoue et al. | |
| 2002/0193899 | A1 | 12/2002 | Shanmugasundram et al. | |
| 2002/0193902 | A1 | 12/2002 | Shanmugasundram et al. | |
| 2002/0197745 | A1 | 12/2002 | Shanmugasundram et al. | |
| 2002/0197934 | A1 | 12/2002 | Paik | |
| 2002/0199082 | A1 | 12/2002 | Shanmugasundram et al. | |
| 2003/0017256 | A1 | 1/2003 | Shimane | |
| 2003/0020909 | A1 | 1/2003 | Adams et al. | |
| 2003/0020928 | A1 | 1/2003 | Ritzdorf et al. | |
| 2003/0154062 | A1 | 8/2003 | Daft et al. | |

FOREIGN PATENT DOCUMENTS

| | | | |
|---|---|---|---|
| CA | 2165847 | | 8/1991 |
| CA | 2194855 | | 8/1991 |
| EP | 0 397 924 | A1 | 11/1990 |
| EP | 0 621 522 | A2 | 10/1994 |
| EP | 0 747 795 | A2 | 12/1996 |
| EP | 0 869 652 | A2 | 10/1998 |
| EP | 0 877 308 | A2 | 11/1998 |
| EP | 0 881 040 | A2 | 12/1998 |
| EP | 0 895 145 | A1 | 2/1999 |
| EP | 0 910 123 | A1 | 4/1999 |
| EP | 0 932 194 | A1 | 7/1999 |
| EP | 0 932 195 | A1 | 7/1999 |
| EP | 1 066 925 | A2 | 1/2001 |
| EP | 1 067 757 | A1 | 1/2001 |
| EP | 1 071 128 | A2 | 1/2001 |
| EP | 1 083 470 | A2 | 3/2001 |
| EP | 1 092 505 | A2 | 4/2001 |
| EP | 1 072 967 | A3 | 11/2001 |
| EP | 1 182 526 | A2 | 2/2002 |
| GB | 2 347 885 | A | 9/2000 |
| GB | 2 365 215 | A | 2/2002 |
| JP | 61-66104 | | 4/1986 |
| JP | 61-171147 | | 8/1986 |
| JP | 01-283934 | | 11/1989 |
| JP | 3-202710 | | 9/1991 |
| JP | 05-151231 | | 6/1993 |
| JP | 05-216896 | | 8/1993 |
| JP | 05-266029 | | 10/1993 |
| JP | 06-110894 | | 4/1994 |
| JP | 06-176994 | | 6/1994 |
| JP | 06-184434 | | 7/1994 |
| JP | 06-252236 | | 9/1994 |
| JP | 06-260380 | | 9/1994 |
| JP | 8-23166 | | 1/1996 |
| JP | 08-50161 | | 2/1996 |
| JP | 08-149583 | | 6/1996 |
| JP | 08-304023 | | 11/1996 |
| JP | 09-34535 | | 2/1997 |
| JP | 9-246547 | | 9/1997 |
| JP | 10-34522 | | 2/1998 |
| JP | 10-173029 | | 6/1998 |
| JP | 11-67853 | | 3/1999 |
| JP | 11-126816 | | 5/1999 |
| JP | 11-135601 | | 5/1999 |
| JP | 2000-183001 | | 6/2000 |
| JP | 2001-76982 | | 3/2001 |
| JP | 2001-284299 | | 10/2001 |
| JP | 2001-305108 | | 10/2001 |
| JP | 2002-9030 | | 1/2002 |
| JP | 2002-343754 | | 11/2002 |
| TW | 434103 | | 5/2001 |
| TW | 436383 | B | 5/2001 |
| TW | 455938 | B | 9/2001 |
| TW | 455976 | | 9/2001 |
| WO | WO 95/34866 | | 12/1995 |
| WO | WO 98/05066 | | 2/1998 |
| WO | WO 98/45090 | | 10/1998 |
| WO | WO 99/09371 | | 2/1999 |
| WO | WO 99/25520 | | 5/1999 |
| WO | WO 99/59200 | | 11/1999 |
| WO | WO 00/00874 | | 1/2000 |
| WO | WO 00/05759 | | 2/2000 |
| WO | WO 00/35063 | | 6/2000 |
| WO | WO 00/54325 | | 9/2000 |
| WO | WO 00/79355 | A1 | 12/2000 |
| WO | WO 01/11679 | A1 | 2/2001 |
| WO | WO 01/15865 | A1 | 3/2001 |
| WO | WO 01/18623 | A1 | 3/2001 |
| WO | WO 01/25865 | A1 | 4/2001 |
| WO | WO 01/33277 | A1 | 5/2001 |
| WO | WO 01/33501 | A1 | 5/2001 |
| WO | WO 01/52055 | A3 | 7/2001 |
| WO | WO 01/52319 | A1 | 7/2001 |
| WO | WO 01/57823 | A2 | 8/2001 |
| WO | WO 01/80306 | A2 | 10/2001 |
| WO | WO 02/17150 | A1 | 2/2002 |
| WO | WO 02/31613 | A2 | 4/2002 |
| WO | WO 02/31613 | A3 | 4/2002 |
| WO | WO 02/33737 | A2 | 4/2002 |
| WO | WO 02/074491 | A1 | 9/2002 |

OTHER PUBLICATIONS

U.S. Appl. No. 09/469,227, filed Dec. 22, 1999, Somekh et al., Multi-Tool Control System, Method and Medium.

U.S. Appl. No. 09/619,044, filed Jul. 19, 2000, Yuan, System and Method of Exporting or Importing Object Data in a Manufacturing Execution System.
U.S. Appl. No. 09/637,620, filed Aug. 11, 2000, Chi et al., Generic Interface Builder.
U.S. Appl. No. 09/656,031, filed Sep. 6, 2000, Chi et al., Dispatching Component for Associating Manufacturing Facility Service Requestors with Service Providers.
U.S. Appl. No. 09/655,542, filed Sep. 6, 2000, Yuan, System, Method and Medium for Defining Palettes to Transform an Application Program Interface for a Service.
U.S. Appl. No. 09/725,908, filed Nov. 30, 2000, Chi et al., Dynamic Subject Information Generation in Message Services of Distributed Object Systems.
U.S. Appl. No. 09/800,980, filed Mar. 8, 2001, Hawkins et al., Dynamic and Extensible Task Guide.
U.S. Appl. No. 09/811,667, filed Mar. 20, 2001, Yuan et al., Fault Tolerant and Automated Computer Software Workflow.
U.S. Appl. No. 09/927,444, filed Aug. 13, 2001, Ward et al., Dynamic Control of Wafer Processing Paths in Semiconductor Manufacturing Processes.
U.S. Appl. No. 09/928,473, filed Aug. 14, 2001, Koh, Tool Services Layer for Providing Tool Service Functions in Conjunction with Tool Functions.
U.S. Appl. No. 09/928,474, filed Aug. 14, 2001, Krishnamurthy et al., Experiment Management System, Method and Medium.
U.S. Appl. No. 09/943,383, filed Aug. 31, 2001, Shanmugasundram et al., In Situ Sensor Based Control of Semiconductor Processing Procedure.
U.S. Appl. No. 09/943,955, filed Aug. 31, 2001, Shanmugasundram et al., Feedback Control of a Chemical Mechanical Polishing Device Providing Manipulation of Removal Rate Profiles.
U.S. Appl. No. 09/998,372, filed Nov. 30, 2001, Paik, Control of Chemical Mechanical Polishing Pad Conditioner Directional Velocity to Improve Pad Life.
U.S. Appl. No. 09/998,384, filed Nov. 30, 2001, Paik, Feedforward and Feedback Control for Conditioning of Chemical Mechanical Polishing Pad.
U.S. Appl. No. 10/084,092, filed Feb. 28, 2002, Arackaparambil et al., Computer Integrated Manufacturing Techniques.
U.S. Appl. No. 10/100,184, filed Mar. 19, 2002, Al-Bayati et al., Method, System and Medium for Controlling Semiconductor Wafer Processes Using Critical Dimension Measurements.
U.S. Appl. No. 10/135,405, filed May 1, 2002, Reiss et al., Integration of Fault Detection with Run-to-Run Control.
U.S. Appl. No. 10/135,451, filed May 1, 2002, Shanmugasundram et al., Dynamic Metrology Schemes and Sampling Schemes for Advanced Process Control in Semiconductor Processing.
U.S. Appl. No. 10/172,977, filed Jun. 18, 2002, Shanmugasundram et al., Method, System and Medium for Process Control for the Matching of Tools, Chambers and/or Other Semiconductor-Related Entities.
U.S. Appl. No. 10/173,108, filed Jun. 18, 2002, Shanmugasundram et al., Integrating Tool, Module, and Fab Level Control.
U.S. Appl. No. 10/174,370, filed Jun. 18, 2002, Shanmugasundram et al., Feedback Control of Plasma-Enhanced Chemical Vapor Deposition Processes.
U.S. Appl. No. 10/174,377, filed Jun. 18, 2002, Schwarm et al., Feedback Control of Sub-Atmospheric Chemical Vapor Deposition Processes.
U.S. Appl. No. 10/377,654, filed Mar. 4, 2003, Kokotov et al., Method, System and Medium for Controlling Manufacturing Process Using Adaptive Models Based on Empirical Data.
U.S. Appl. No. 10/393,531, filed Mar. 21, 2003, Shanmugasundram et al., Copper Wiring Module Control.
U.S. Appl. No. 10/632,107, filed Aug. 1, 2003, Schwarm et al., Method, System, and Medium for Handling Misrepresentative Metrology Data Within an Advanced Process Control System.
U.S. Appl. No. 10/665,165, filed Sep. 18, 2003, Paik, Feedback Control of a Chemical Mechanical Polishing Process for Multi-Layered Films.
U.S. Appl. No. 10/712,273, filed Nov. 14, 2003, Kokotov, Method, System and Medium for Controlling Manufacture Process Having Multivariate Input Parameters.
U.S. Appl. No. 10/759,108, filed Jan. 20, 2004, Schwarm, Automated Design and Execution of Experiments with Integrated Model Creation for Semiconductor Manufacturing Tools.
U.S. Appl. No. 10/765,921, filed Jan. 29, 2004, Schwarm, System, Method, and Medium for Monitoring Performance of an Advanced Process Control System.
U.S. Appl. No. 10/809,908, filed Mar. 26, 2004, Yang et al., Improved Control of Metal Resistance in Semiconductor Products via Integrated Metrology.
Miller, G. L., D. A. H. Robinson, and J. D. Wiley. Jul. 1976. "Contactless measurement of semiconductor conductivity by radio frequency-free-carrier power absorption." *Rev. Sci. Instrum.*, vol. 47, No. 7. pp. 799-805.
Ostanin, Yu.Ya. Oct. 1981. "Optimization of Thickness Inspection of Electrically Conductive Single-Layer Coatings with Laid-on Eddy-Current Transducers (Abstract)." *Defektoskopiya*, vol. 17, No. 10, pp. 45-52. Moscow, USSR.
Feb. 1984. "Method and Apparatus of in Situ Measurement and Overlay Error Analysis for Correcting Step and Repeat Lithographic Cameras." *IBM Technical Disclosure Bulletin*, pp. 4855-4859.
Feb. 1984. "Substrate Screening Process." *IBM Technical Disclosure Bulletin*, pp. 4824-4825.
Oct. 1984. "Method to Characterize the Stability of a Step and Repeat Lithographic System." *IBM Technical Disclosure Bulletin*, pp. 2857-2860.
Levine, Martin D. 1985. *Vision in Man and Machine*. New York: McGraw-Hill, Inc. pp. ix-xii, 1-58.
Herrmann, D. 1988. "Temperature Errors and Ways of Elimination for Contactless Measurement of Shaft Vibrations (Abstract)." *Technisches Messen*™, vol. 55, No. 1, pp. 27-30. West Germany.
Lin, Kuang-Kuo and Costas J. Spanos. Nov. 1990. "Statistical Equipment Modeling for VLSI Manufacturing: An Application for LPCVD." *IEEE Transactions on Semiconductor Manufacturing*, v. 3, n. 4, pp. 216-229.
Runyan, W. R., and K. E. Bean. 1990. "Semiconductor Integrated Circuit Processing Technology." p. 48. Reading, Massachusetts: Addison-Wesley Publishing Company.
Chang, Norman H. and Costas J. Spanos. Feb. 1991. "Continuous Equipment Diagnosis Using Evidence Integration: An LPCVD Application." *IEEE Transactions on Semiconductor Manufacturing*, v. 4, n. 1, pp. 43-51.
Larrabee, G. B. May 1991. "The Intelligent Microelectronics Factory of the Future (Abstract)." *IEEE/SEMI International Semiconductor Manufacturing Science Symposium*, pp. 30-34. Burlingame, CA.
Burke, Peter A. Jun. 1991. "Semi-Empirical Modelling of SiO2 Chemical-Mechanical Polishing Planarization." *VMIC Conference, 1991 IEEE*, pp. 379-384. IEEE.
Zorich, Robert. 1991. *Handbook of Quality Integrated Circuit Manufacturing*. pp. 464-498 San Diego, California: Academic Press, Inc.
Rampalli, Prasad, Arakere Ramesh, and Nimish Shah. 1991. *CEPT—A Computer-Aided Manufacturing Application for Managing Equipment Reliability and Availability in the Semiconductor Industry*. New York, New York: IEEE.
May 1992. "Laser Ablation Endpoint Detector." *IBM Technical Disclosure Bulletin*, pp. 333-334.
Spanos, Costas J., Hai-Fang Guo, Alan Miller, and Joanne Levine-Parrill. Nov. 1992. "Real-Time Statistical Process Control Using Tool Data." *IEEE Transactions on Semiconductor Manufacturing*, v. 5, n. 4, pp. 308-318.
Feb. 1993. "Electroless Plating Scheme to Hermetically Seal Copper Features." *IBM Technical Disclosure Bulletin*, pp. 405-406.
Scarr, J. M. and J. K. Zelisse. Apr. 1993. "New Topology for Thickness Monitoring Eddy Current Sensors (Abstract)." *Proceedings of the 36th Annual Technical Conference*, Dallas, Texas.
Hu, Albert, Kevin Nguyen, Steve Wong, Xiuhua Zhang, Emanuel Sachs, and Peter Renteln. 1993. "Concurrent Deployment of Run by Run Controller Using SCC Framework." IEEE/SEMI International Semiconductor Manufacturing Science Symposium. pp. 126-132.

Matsuyama, Akira and Jessi Niou. 1993. "A State-of-the-Art Automation System of an ASIC Wafer Fab in Japan." *IEEE/SEMI International Semiconductor Manufacturing Science Syposium*, pp. 42-47.

Yeh, C. Eugene, John C. Cheng, and Kwan Wong. 1993. "Implementation Challenges of a Feedback Control System for Wafer Fabrication." *IEEE/CHMT International Electronics Manufacturing Technology Symposium*, pp. 438-442.

Kurtzberg, Jerome M. and Menachem Levanoni. Jan. 1994. "ABC: A Better Control for Manufacturing." *IBM Journal of Research and Development*, v. 38, n. 1, pp. 11-30.

Mozumder, Purnendu K. and Gabriel G. Barna. Feb. 1994. "Statistical Feedback Control of a Plasma Etch Process." *IEEE Transactions on Semiconductor Manufacturing*, v. 7, n. 1, pp. 1-11.

Muller-Heinzerling, Thomas, Ulrich Neu, Hans Georg Nurnberg, and Wolfgang May. Mar. 1994. "Recipe-Controlled Operation of Batch Processes with Batch X." *ATP Automatisierungstechnische Praxis*, vol. 36, No. 3, pp. 43-51.

Stoddard, K., P. Crouch, M. Kozicki, and K. Tsakalis. Jun.-Jul. 1994. "Application of Feedforward and Adaptive Feedback Control to Semiconductor Device Manufacturing (Abstract)." *Proceedings of 1994 American Control Conference—ACC '94*, vol. 1, pp. 892-896. Baltimore, Maryland.

Rocha, Joao and Carlos Ramos. Sep. 12, 1994. "Task Planning for Flexible and Agile Manufacturing Systems." *Intelligent Robots and Systems '94. Advanced Robotic Systems and the Real World, IROS '94. Proceedings of the IEEE/RSJ/GI International Conference on Munich, Germany* Sep. 12-16, 1994. New York, New York: IEEE. pp.105-112.

Schaper, C. D., M. M. Moslehi, K. C. Saraswat, and T. Kailath. Nov. 1994. "Modeling, Identification, and Control of Rapid Thermal Processing Systems (Abstract)." *Journal of the Electrochemical Society*, vol. 141, No. 11, pp. 3200-3209.

Tao, K. M., R. L. Kosut, M. Ekblad, and G. Aral. Dec. 1994. "Feedforward Learning Applied to RTP of Semiconductor Wafers (Abstract)." *Proceedings of the 33rd IEEE Conference on Decision and Control* , vol. 1, pp. 67-72. Lake Buena Vista, Florida.

Hu, Albert, He Du, Steve Wong, Peter Renteln, and Emmanuel Sachs. 1994. "Application of Run by Run Controller to the Chemical-Mechanical Planarization Process." *IEEE/CMPT International Electronics Manufacturing Technology Symposium*, pp. 371-378.

Spanos, C. J., S. Leang, S.-Y. Ma, J. Thomson, B. Bombay, and X. Niu. May 1995. "A Multistep Supervisory Controller for Photolithographic Operations (Abstract)." *Proceedings of the Symposium on Process Control, Diagnostics, and Modeling in Semiconductor Manufacturing*, pp. 3-17.

Moyne, James, Roland Telfeyan, Arnon Hurwitz, and John Taylor. Aug. 1995. "A Process-Independent Run-to-Run Controller and Its Application to Chemical-Mechanical Planarization." *SEMI/IEEE Advanced Semiconductor Manufacturing Conference and Workshop*. Ann Arbor, Michigan: The University of Michigan, Electrical Engineering & Computer Science Center for Display Technology & Manufacturing.

Zhou, Zhen-Hong and Rafael Reif. Aug. 1995. "Epi-Film Thickness Measurements Using Emission Fourier Transform Infrared Spectroscopy—Part II: Real-Time in Situ Process Monitoring and Control." IEEE Transactions on Semiconductor Manufacturing, vol. 8, No. 3.

Telfeyan, Roland, James Moyne, Nauman Chaudhry, James Pugmire, Scott Shellman, Duane Boning, William Moyne, Arnon Hurwitz, and John Taylor. Oct. 1995. "A Multi-Level Approach to the Control of a Chemical-Mechanical Planarization Process." Minneapolis, Minnesota: 42nd National Symposium of the American Vacuum Society.

Chang, E., B. Stine, T. Maung, R. Divecha, D. Boning, J. Chung, K. Chang, G. Ray, D. Bradbury, O. S. Nakagawa, S. Oh, and D. Bartelink. Dec. 1995. "Using a Statistical Metrology Framework to Identify Systematic and Random Sources of Die- and Wafer-level ILD Thickness Variation in CMP Processes." Washington, D.C.: International Electron Devices Meeting.

Moyne, James R., Nauman Chaudhry, and Roland Telfeyan. 1995. "Adaptive Extensions to a Multi-Branch Run-to-Run Controller for Plasma Etching." *Journal of Vacuum Science and Technology*. Ann Arbor, Michigan: University of Michigan Display Technology Manufacturing Center.

Schmid, Hans Albrecht. 1995. "Creating the Architecture of a Manufacturing Framework by Design Patterns." Austin, Texas: OOPSLA.

Dishon, G., M. Finarov, R. Kipper, J.W. Curry, T. Schraub, D. Trojan, 4th Stambaugh, Y. Li and J. Ben-Jacob. Feb. 1996. "On-Line Integrated Metrology for CMP Processing." Santa Clara, California: VMIC Speciality Conferences, 1st International CMP Planarization Conference.

Leong, Sovarong, Shang-Yi Ma, John Thomson, Bart John Bombay, and Costas J. Spanos. May 1996. "A Control System for Photolithographic Sequences." *IEEE Transactions on Semiconductor Manufacturing*, vol. 9, No. 2.

Smith, Taber, Duane Boning, James Moyne, Arnon Hurwitz, and John Curry. Jun. 1996. "Compensating for CMP Pad Wear Using Run by Run Feedback Control." Santa Clara, California: Proceedings of the Thirteenth International VLSI Multilevel Interconnection Conference. pp. 437-439.

Boning, Duane S., William P. Moyne, Taber H. Smith, James Moyne, Ronald Telfeyan, Arnon Hurwitz, Scott Shellman, and John Taylor. Oct. 1996. "Run by Run Control of Chemical-Mechanical Polishing." *IEEE Transactions on Components, Packaging, and Manufacturing Technology—Part C*, vol. 19, No. 4, pp. 307-314.

Zhe, Ning, J. R. Moyne, T. Smith, D. Boning, E. Del Castillo, Yeh Jinn-Yi, and Hurwitz. Nov. 1996. "A Comparative Analysis of Run-to-Run Control Algorithms in Semiconductor Manufacturing Industry (Abstract)." *IEEE/SEMI 1996 Advanced Semiconductor Manufacturing Conference Workshop*, pp. 375-381.

Yasuda, M., T. Osaka, and M. Ikeda. Dec. 1996. "Feedforward Control of a Vibration Isolation System for Disturbance Suppression (Abstract)." *Proceeding of the 35th IEEE Conference on Decision and Control*, vol. 2, pp. 1229-1233. Kobe, Japan.

Fan, Jr-Min, Ruey-Shan Guo, Shi-Chung Chang, and Kian-Huei Lee. 1996. "Abnormal Trend Detection of Sequence-Disordered Data Using EWMA Method." *IEEE/SEMI Advanced Semiconductor Manufacturing Conference*, pp. 169-174.

SEMI. [1986] 1996. "Standard for Definition and Measurement of Equipment Reliability, Availability, and Maintainability (RAM)." SEMI E10-96.

Smith, Taber and Duane Boning. 1996. "A Self-Tuning EWMA Controller Utilizing Artificial Neural Network Function Approximation Techniques." *IEEE/CPMT International Electronics Manufacturing Technology Symposium*, pp. 355-363.

Guo, Ruey-Shan, Li-Shia Huang, Argon Chen, and Jin-Jung Chen. Oct. 1997. "A Cost-Effective Methodology for a Run-by-Run EWMA Controller." *6th International Symposium on Semiconductor Manufacturing*, pp. 61-64.

Mullins, J. A., W. J. Campbell, and A. D. Stock. Oct. 1997. "An Evaluation of Model Predictive Control in Run-to-Run Processing in Semiconductor Manufacturing (Abstract)." *Proceedings of the SPIE—The International Society for Optical Engineering Conference*, vol. 3213, pp. 182-189.

Reitman, E. A., D. J. Friedman, and E. R. Lory. Nov. 1997. "Pre-Production Results Demonstrating Multiple-System Models for Yield Analysis (Abstract)." *IEEE Transactions on Semiconductor Manufacturing*, vol. 10, No. 4, pp. 469-481.

Durham, Jim and Myriam Roussel. 1997. "A Statistical Method for Correlating In-Line Defectivity to Probe Yield." *IEEE/SEMI Advanced Semiconductor Manufacturing Conference*, pp. 76-77.

Shindo, Wataru, Eric H. Wang, Ram Akella, and Andrzej J. Strojwas. 1997. "Excursion Detection and Source Isolation in Defect Inspection and Classification." *2nd International Workshop on Statistical Metrology*, pp. 90-93.

Van Zant, Peter. 1997. *Microchip Fabrication: A Practical Guide to Semiconductor Processing*. Third Edition, pp. 472-478. New York, New York: McGraw-Hill.

Campbell, W. Jarrett, and Anthony J. Toprac. Feb. 11-12, 1998. "Run-to-Run Control in Microelectronics Manufacturing." Advanced Micro Devises, TWMCC.

Edgar, Thomas F., Stephanie W. Butler, Jarrett Campbell, Carlos Pfeiffer, Chris Bode, Sung Bo Hwang, and K.S. Balakrishnan. May 1998. "Automatic Control in Microelectronics Manufacturing: Practices, Challenges, and Possibilities." Automatica, vol. 36, pp. 1567-1603, 2000.
Moyne, James, and John Curry. Jun. 1998. "A Fully Automated Chemical-Mechanical Planarization Process." Santa Clara, California: VLSI Multilevel Interconnection (V-MIC) Conference.
Jul. 1998. "Active Controller: Utilizing Active Databases for Implementing Multistep Control of Semiconductor Manufacturing (Abstract)." *IEEE Transactions on Components, Packaging and Manufacturing Technology—Part C*, vol. 21, No. 3, pp. 217-224.
SEMI. Jul. 1998. *New Standard: Provisional Specification for CIM Framework Domain Architecture*. Mountain View, California: SEMI Standards. SEMI Draft Doc. 2817.
Consilium. Aug. 1998. *Quality Management Component: QMC™ and QMC-Link™ Overview*. Mountain View, California: Consilium, Inc.
Chemali, Chadi El, James Moyne, Kareemullah Khan, Rock Nadeau, Paul Smith, John Colt, Jonathan Chapple-Sokol, and Tarun Parikh. Nov. 1998. "Multizone Uniformity Control of a CMP Process Utilizing a Pre and Post-Measurement Strategy." Seattle, Washington: SEMETECH Symposium.
Consilium. 1998. *FAB300™*. Mountain View, California: Consilium, Inc.
Fang, S. J., A. Barda, T. Janecko, W. Little, D. Outley, G. Hempel, S. Joshi, B. Morrison, G. B. Shinn, and M. Birang. 1998. "Control of Dielectric Chemical Mechanical Polishing (CMP) Using and Interferometry Based Endpoint Sensor." *International Proceedings of the IEEE Interconnect Technology Conference*, pp. 76-78.
Khan, Kareemullah, Victor Solakhain, Anthony Ricci, Tier Gu, and James Moyne. 1998. "Run-to-Run Control of ITO Deposition Process." Ann Arbor, Michigan.
Ouma, Dennis, Duane Boning, James Chung, Greg Shinn, Leif Olsen, and John Clark. 1998. "An Integrated Characterization and Modeling Methodology for CMP Dielectric Planarization." *Proceedings of the IEEE 1998 International Interconnect Technology Conference*, pp. 67-69.
Suzuki, Junichi and Yoshikazu Yamamoto. 1998. "Toward the Interoperable Software Design Models: Quartet of UML, XML, DOM and CORBA." Proceedings IEEE International Software Engineering Standards Symposium. pp. 1-10.
Consilium. Jan. 1999. "FAB300™: Consilium's Next Generation MES Solution of Software and Services which Control and Automate Real-Time FAB Operations." www.consilium.com/products/fab300_page.htm#FAB300 Introduction.
Boning, Duane S., Jerry Stefani, and Stephanie W. Butler. Feb. 1999. "Statistical Methods for Semiconductor Manufacturing." *Encyclopedia of Electrical Engineering*, J. G. Webster, Ed.
McIntosh, John. Mar. 1999. "Using CD-SEM Metrology in the Manufacture of Semiconductors (Abstract)." *JOM*, vol. 51, No. 3, pp. 38-39.
Pan, J. Tony, Ping Li, Kapila Wijekoon, Stan Tsai, and Fritz Redeker. May 1999. "Copper CMP Integration and Time Dependent Pattern Effect." *IEEE 1999 International Interconnect Technology Conference*, pp. 164-166.
Klein, Bruce. Jun. 1999. "Application Development: XML Makes Object Models More Useful." Informationweek. pp. 1A-6A.
Baliga, John. Jul. 1999. "Advanced Process Control: Soon to be a Must." Cahners Semiconductor International. www.semiconductor.net/semiconductor/issues/issues/1999/jul99/docs/feature1.asp.
Consilium. Jul. 1999. "Increasing Overall Equipment Effectiveness (OEE) in Fab Manufacturing by Implementing Consilium's Next-Generation Manufacturing Execution System—MES II." Semiconductor Fabtech Edition 10.
Meckl, P. H. and K. Umemoto. Aug. 1999. "Achieving Fast Motions in Semiconductor Manufacturing Machinery (Abstract)." *Proceedings of the 1999 IEEE International Conference on Control Applications*, vol. 1, pp. 725-729. Kohala Coast, HI.
Consilium Corporate Brochure. Oct. 1999. www.consilium.com.
Khan, K., C. El Chemali, J. Moyne, J. Chapple-Sokol, R. Nadeau, P. Smith, C., and T. Parikh. Oct. 1999. "Yield Improvement at the Contact Process Through Run-to-Run Control (Abstract)." *24th IEEE/CPMT Electronics Manufacturing Technology Symposium*, pp. 258-263.
Moyne, James. Oct. 1999. "Advancements in CMP Process Automation and Control." Hawaii: (Invited paper and presentation to) Third International Symposium on Chemical Mechanical Polishing in IC Device Manufacturing: 196th Meeting of the Electrochemical Society.
Williams, Randy, Dadi Gudmundsson, Kevin Monahan, Raman Nurani, Meryl Stoller and J. George Shanthikumar. Oct. 1999. "Optimized Sample Planning for Wafer Defect Inspection," *Semiconductor Manufacturing Conference Proceedings, 1999 IEEE International Symposium on Santa Clara, CA*. Piscataway, NJ. pp. 43-46.
Consilium. Nov. 1999. *FAB300™ Update*.
Ruegsegger, Steven, Aaron Wagner, James S. Freudenberg, and Dennis S. Grimard. Nov. 1999. "Feedforward Control for Reduced Run-to-Run Variation in Microelectronics Manufacturing." *IEEE Transactions on Semiconductor Manufacturing*, vol. 12, No. 4.
1999. "Contactless Bulk Resistivity/Sheet Resistance Measurement and Mapping Systems." www.Lehighton.com/fabtechl/index.html.
Nov. 1999. "How to Use EWMA to Achieve SPC and EPC Control." *International Symposium on NDT Contribution to the Infrastructure Safety Systems*, Tores, Brazil. <http://www.ndt.net/abstract/ndtiss99/data/35.htm>.
Edgar, T. F., W. J. Campbell, and C. Bode. Dec. 1999. "Model-Based Control in Microelectronics Manufacturing." *Proceedings of the 38th IEEE Conference on Decision and Control*, Phoenix, Arizona, vol. 4, pp. 4185-4191.
Meckl, P. H. and K. Umemoto. Apr. 2000. "Achieving Fast Motions by Using Shaped Reference Inputs [Semiconductor Manufacturing Machine] (Abstract)." *NEC Research and Development*, vol. 41, No. 2, pp. 232-237.
Chemali, Chadi El, James Moyne, Kareemullah Khan, Rock Nadeau, Paul Smith, John Colt, Jonathan Chapple-Sokol, and Tarun Parikh. Jul./Aug. 2000. "Multizone Uniformity Control of a Chemical Mechanical Polishing Process Utilizing a Pre- and Postmeasurement Strategy." J. Vac. Sci. Technol. A, vol. 18(4). pp. 1287-1296. American Vacuum Society.
Oechsner, R., T. Tschaftary, S. Sommer, L. Pfitzner, H. Ryssel, H. Gerath, C. Baier, and M. Hafner. Sep. 2000. "Feed-forward Control for a Lithography/Etch Sequence (Abstract)." *Proceedings of the SPIE—The International Society for Optical Engineering Conference*, vol. 4182, pp. 31-39.
Cheung, Robin. Oct. 18, 2000. "Copper Interconnect Technology." *AVS/CMP User Group Meeting*, Santa Clara, CA.
Edgar, Thomas F., Stephanie W. Butler, W. Jarrett Campbell, Carlos Pfeiffer, Christopher Bode, Sung Bo Hwang, K. S. Balakrishnan, and J. Hahn. Nov. 2000. "Automatic Control in Microelectronics Manufacturing: Practices, Challenges, and Possibilities (Abstract)." *Automatica*, v. 36, n. 11.
Khan, S., M. Musavi, and H. Ressom. Nov. 2000. "Critical Dimension Control in Semiconductor Manufacturing (Abstract)." *ANNIE 2000. Smart Engineering Systems Design Conference*, pp. 995-1000. St. Louis, Missouri.
ACM Research Inc. 2000. "Advanced Copper Metallization for 0.13 to 0.05 μm & Beyond." <http://acmrc.com/press/ACM-ECP-brochure.pdf>.
Ravid, Avi, Avner Sharon, Amit Weingarten, Vladimir Machavariani, and David Scheiner. 2000. "Copper CMP Planarity Control Using ITM." *IEEE/SEMI Advanced Semiconductor Manufacturing Conference*, pp. 437-443.
SEMI. 2000. "Provisional Specification for CIM Framework Scheduling Component." San Jose, California. SEMI E105-1000.
2000. "Microsense II Capacitance Gaging System." www.adetech.com.
Chen, Argon and Ruey-Shan Guo. Feb. 2001. "Age-Based Double EWMA Controller and Its Application to CMP Processes." *IEEE Transactions on Semiconductor Manufacturing*, vol. 14, No. 1, pp. 11-19.
Mar. 5, 2001. "KLA-Tencor Introduces First Production-worthy Copper CMP In-situ Film Thickness and End-point Control System." http://www.kla-tencor.com/j/servlet/NewsItem?newsItemID=74.
Lee, Brian, Duane S. Boning, Winthrop Baylies, Noel Poduje, Pat Hester, Yong Xia, John Valley, Chris Koliopoulus, Dale Hetherington, HongJiang Sun, and Michael Lacy. Apr. 2001. "Wafer Nanotopography Effects on CMP: Experimental Validation of Modeling Methods." San Francisco, California: Materials Research Society Spring Meeting.
Tobin, K. W., T. P. Karnowski, L. F. Arrowood, and F. Lakhani. Apr. 2001. "Field Test Results of an Automated Image Retrieval System (Abstract)." *Advanced Semiconductor Manufacturing Conference, 2001 IEEE/SEMI*, Munich, Germany.
Tan, K. K., H. F. Dou, and K. Z. Tang. May-Jun. 2001. "Precision Motion Control System for Ultra-Precision Semiconductor and Electronic Components Manufacturing (Abstract)." *51st Electronic Components and Technology Conference 2001. Proceedings*, pp. 1372-1379. Orlando, Florida.
Jensen, Alan, Peter Renteln, Stephen Jew, Chris Raeder, and Patrick Cheung. Jun. 2001. "Empirical-Based Modeling for Control of CMP Removal Uniformity." Solid State Technology, vol. 44, No. 6, pp. 101-102, 104, 106. Cowan Publ. Corp.: Washington, D.C.
Jul. 5, 2001. "Motorola and Advanced Micro Devices Buy ObjectSpace Catalyst Advanced Process Control Product for Five Wafer Fabs." Semiconductor FABTECH. www.semiconductorfabtech.com/industry.news/9907/20.07.shtml.
Heuberger, U. Sep. 2001. "Coating Thickness Measurement with Dual-Function Eddy-Current & Magnetic Inductance Instrument (Abstract)." *Galvanotechnik*, vol. 92, No. 9, pp. 2354-2366+IV.
Pilu, Maurizio. Sep. 2001. "Undoing Page Curl Distortion Using Applicable Surfaces." *IEEE International Conference on Image Processing*. Thessalonica, Greece.
Oct. 15, 2001. Search Report prepared by the Austrian Patent Office for Singapore Patent Application No. 200004286-1.
Wang, LiRen and Hefin Rowlands. 2001. "A Novel NN-Fuzzy-SPC Feedback Control System." *8th IEEE International Conference on Emerging Technologies and Factory Automation*, pp. 417-423.
NovaScan 2020. Feb. 2002. "Superior Integrated Process Control for Emerging CMP High-End Applications."
Mar. 15, 2002. Office Action for U.S. Appl. No. 09/469,227, filed Dec. 22, 1999.
Mar. 29, 2002. Office Action for U.S. Appl. No. 09/363,966, filed Jul. 29, 1999.
Moyne, J., V. Solakhian, A. Yershov, M. Anderson, and D. Mockler-Hebert. Apr.-May 2002. "Development and Deployment of a Multi-Component Advanced Process Control System for an Epitaxy Tool (Abstract)." *2002 IEEE Advanced Semiconductor Manufacturing Conference and Workshop*, pp. 125-130.
Sarfaty, Moshe, Arulkumar Shanmugasundram, Alexander Schwarm, Joseph Paik, Jimin Zhang, Rong Pan, Martin J. Seamons, Howard Li, Raymond Hung, and Suketu Parikh. Apr.-May 2002. "Advance Process Control Solutions for Semiconductor Manufacturing." Boston, Massachusetts: *13th Annual IEEE/SEMI Advanced Semiconductor Manufacturing Conference. Advancing the Science and Technology of Semiconductor Manufacturing. ASMC 2002*, pp. 101-106.
Campbell, W. J., S. K. Firth, A. J. Toprac, and T. F. Edgar. May 2002. "A Comparison of Run-to-Run Control Algorithms (Abstract)." *Proceedings of 2002 American Control Conference*, vol. 3, pp. 2150-2155.
Good, Richard and S. Joe Qin. May 2002. "Stability Analysis of Double EWMA Run-to-Run Control with Metrology Delay." *IEEE/CPMT International Electronics Manufacturing Technology Symposium*, pp. 355-363.
Smith, Stewart, Anthony J. Walton, Alan W. S. Ross, Georg K. H. Bodammer, and J. T. M. Stevenson. May 2002. "Evaluation of Sheet Resistance and Electrical Linewidth Measurement Techniques for Copper Damascene Interconnect." *IEEE Transactions on Semiconductor Manufacturing*, vol. 15, No. 2, pp. 214-222.
Johnson, Bob. Jun. 10, 2002. "Advanced Process Control Key to Moore's Law." Gartner, Inc.
Jun. 20, 2002. Office Action for U.S. Appl. No. 09/619,044, filed Jul. 19, 2000.
Itabashi, Takeyuki, Hiroshi Nakano, and Haruo Akahoshi. Jun. 2002. "Electroless Deposited CoWB for Copper Diffusion Barrier Metal." *IEEE International Interconnect Technology Conference*, pp. 285-287.
Jul. 9, 2002. International Search Report for PCT/US01/24910.
Jul. 23, 2002. Communication Pursuant to Article 96(2) EPC for European Patent Application No. 00 115 577.9.
Jul. 29, 2002. International Search Report for PCT/US01/27407.
Sep. 26, 2002. Office Action for U.S. Appl. No. 09/637,620, filed Aug. 11, 2000.
Oct. 4, 2002. International Search Report for PCT/US01/22833.
Oct. 15, 2002. International Search Report for PCT/US02/19062.
Oct. 23, 2002. International Search Report for PCT/US01/27406.
Oct. 23, 2002. Office Action for U.S. Appl. No. 09/469,227, filed Dec. 22, 1999.
Nov. 7, 2002. International Search Report for PCT/US02/19061.
Nov. 11, 2002. International Search Report for PCT/US02/19117.
Nov. 12, 2002. International Search Report for PCT/US02/19063.
Dec. 17, 2002. Office Action for U.S. Appl. No. 09/363,966, filed Jul. 29, 1999.
ACM Research, Inc. 2002. "ACM Ultra ECP® System: Electro-Copper Plating (ECP) Deposition." www.acmrc.com/ecp.html.
Applied Materials, Inc. 2002. "Applied Materials: Information for Everyone: Copper Electrochemical Plating." www.appliedmaterials.com/products/copper_electrochemical_plating.html.
KLA-Tencor Corporation. 2002. "KLA Tencor: Press Release: KLA-Tencor Introduces First Production-Worthy Copper CMP In-Situ Film Thickness and End-point Control System: Multi-Million Dollar Order Shipped to Major CMP Tool Manufacturer." www.kla-tencor.com/news_events/press_releases2001/984086002.html.
Sonderman, Thomas. 2002. "APC as a Competitive Manufacturing Technology: *AMD' s Vision for 300mm*." AEC/APC.
Takahashi, Shingo, Kaori Tai, Hiizu Ohtorii, Naoki Komai, Yuji Segawa, Hiroshi Horikoshi, Zenya Yasuda, Hiroshi Yamada, Masao Ishihara, and Takeshi Nogami. 2002. "Fragile Porous Low-k/Copper Integration by Using Electro-Chemical Polishing." *2002 Symposium on VLSI Technology Digest of Technical Papers*, pp. 32-33.
2002. "Microsense II—5810: Non-Contact Capacitance Gaging Module." www.adetech.com.
Feb. 10, 2003. Office Action for U.S. Appl. No. 09/619,044, filed Jul. 19, 2000.
Mar. 25, 2003. International Search Report for PCT/US02/24859.
Apr. 9, 2003. Office Action for U.S. Appl. No. 09/928,474, filed Aug. 14, 2001.
May 8, 2003. Office Action for U.S. Appl. No. 09/637,620, filed Aug. 11, 2000.
May 23, 2003. Written Opinion for PCT/US01/24910.
Jun. 18, 2003. Office Action for U.S. Appl. No. 09/655,542, filed Sep. 6, 2000.
Jul. 23, 2003. Invitation to Pay Additional Fees and Communication Relating to the Results of the Partial International Search for PCT/US02/19116.
Aug. 1, 2003. Written Opinion for PCT/US01/27406.
Aug. 8, 2003. PCT International Search Report from PCT/US03/08513.
Aug. 20, 2003. Written Opinion for PCT/US01/22833.
Aug. 25, 2003. Office Action for U.S. Appl. No. 10/100,184, filed Mar. 19, 2002.
Sep. 15, 2003. Office Action for U.S. Appl. No. 09/928,474, filed Aug. 14, 2001.
Oct. 14, 2003. PCT International Search Report from PCT/US02/21942.
Oct. 20, 2003. PCT International Search Report from PCT/US02/19116.
Oct. 23, 2003. PCT International Preliminary Examination Report from PCT/US01/24910.
Nov. 5, 2003. Office Action for U.S. Appl. No. 10/172,977, filed Jun. 18, 2002.
Dec. 1, 2003. Office Action for U.S. Appl. No. 10/173,108, filed Jun. 18, 2002.
"NanoMapper wafer nanotopography measurement by ADE Phase Shift." Printed Dec. 9, 2003. http://www.phase-shift.com/nanomap.shtml.
"Wafer flatness measurement of advanced wafers." Printed Dec. 9, 2003. http://www.phase-shift.com/wafer-flatness.shtml.
"ADE Technologies, Inc.—6360." Printed Dec. 9, 2003. http://www.adetech.com/6360.shtml.

"3D optical profilometer MicroXAM by ADE Phase Shift." Printed Dec. 9, 2003. http://www.phase-shift.com/microxam.shtml.
"NanoMapper FA factory automation wafer nanotopography measurement." Printed Dec. 9, 2003. http://www.phase-shift.com/nanomapperfa.shtml.
Dec. 11, 2003. Office Action for U.S. Appl. No. 09/943,383, filed Aug. 31, 2001.
Dec. 16, 2003. International Search Report for PCT/US03/23964.
Cunningham, James A. 2003. "Using Electrochemistry to Improve Copper Interconnects." <http://www.e-insite.net/semiconductor/index.asp?layout=article&articleid=CA47465>.
Jan. 20, 2004. Office Action for U.S. Appl. No. 09/927,444, filed Aug. 13, 2001.
Jan. 23, 2004. International Search Report for PCT/US02/24860.
Feb. 2, 2004. Office Action for U.S. Appl. No. 09/363,966, filed Jul. 29, 1999.
Adams, Bret W., Bogdan Swedek, Rajeev Bajaj, Fritz Redeker, Manush Birang, and Gregory Amico. "Full-Wafer Endpoint Detection Improves Process Control in Copper CMP." *Semiconductor Fabtech*—12th Edition. Applied Materials, Inc., Santa Clara, CA.
Berman, Mike, Thomas Bibby, and Alan Smith. "Review of In Situ & In-line Detection for CMP Applications." *Semiconductor Fabtech*, 8th Edition, pp. 267-274.
Dishon, G., D. Eylon, M. Finarov, and A. Shulman. "Dielectric CMP Advanced Process Control Based on Integrated Monitoring." Ltd. Rehoveth, Israel: Nova Measuring Instruments.
"Semiconductor Manufacturing: An Overview." <http://users.ece.gatech.edu/~gmay/overview.html>.
Boning, Duane et al. "Run by Run Control of Chemical-Mechanical Polishing." *IEEE Trans*. Oct. 1996. vol. 19, No. 4. pp. 307-314.
Moyne, James et al. "A Run-to-Run Control Framework for VLSI Manufacturing." *Microelectronic Processing '93 Conference Proceedings*. Sep. 1993.
Telfeyan, Roland et al. "Demonstration of a Process-Independent Run-to-Run Controller." *187th Meeting of the Electrochemical Society*. May 1995.
Moyne, James et al. "A Process-Independent Run-to-Run Controller and Its Application to Chemical-Mechanical Planarization." *SEMI/IEEE* Adv. Semiconductor Manufacturing Conference. Aug. 15, 1995.
Moyne, James et al. "Adaptive Extensions to be a Multi-Branch Run-to-Run Controller for Plasma Etching." *Journal of Vacuum Science and Technology*. 1995.
Sachs, Emanuel et al. "Process Control System for VLSI Fabrication."
Chaudhry, Nauman et al. "Active Controller: Utilizing Active Databases for Implementing Multi-Step Control of Semiconductor Manufacturing." *Universitiy of Michigan*. pp 1-24.
Chaudhry, Nauman et al. "Designing Databases with Fuzzy Data and Rules for Application to Discrete Control." *University of Michigan*. pp. 1-21.
Chaudhry, Nauman A. et al. "A Design Methodology for Databases with Uncertain Data." *University of Michigan*. pp. 1-14.
Khan, Kareemullah et al. "Run-to-Run Control of ITO Deposition Process." *University of Michigan*. pp. 1-6.
Moyne, James et al. "Yield Improvement @ Contact Through Run-to-Run Control."
Kim, Jiyoun et al. "Gradient and Radial Uniformity Control of a CMP Process Utilizing a Pre- and Post-Measurement Strategy." *University of Michigan*.
Sun, S.C. 1998. "CVD and PVD Transition Metal Nitrides as Diffusion Barriers for Cu Metallization." *IEEE*. pp. 243-246.
Tagami, M., A. Furuya, T. Onodera, and Y. Hayashi. 1999. "Layered Ta-nitrides (LTN) Barrier Film by Power Swing Sputtering (PSS) Technique for MOCVD-Cu Damascene Interconnects." *IEEE*. pp. 635-638.
Yamagishi, H., Z. Tokei, G.P. Beyer, R. Donaton, H. Bender, T. Nogami, and K. Maex. 2000. "TEM/SEM Investigation and Electrical Evaluation of a Bottomless I-PVD TA(N) Barrier in Dual Damascene" (Abstract). *Advanced Metallization Conference 2000*. San Diego, CA.
Eisenbraun, Eric, Oscar van der Straten, Yu Zhu, Katharine Dovidenko, and Alain Kaloyeros. 2001. "Atomic Layer Deposition (ALD) of Tantalum-Based Materials for Zero Thickness Copper Barrier Applications" (Abstract). *IEEE*. pp. 207-209.
Smith, S.R., K.E. Elers, T. Jacobs, V. Blaschke, and K. Pfeifer. 2001. "Physical and Electrical Characterization of ALD Tin Used as a Copper Diffusion Barrier in 0.25 mum, Dual Damascene Backend Structures" (Abstract). *Advanced Metallization Conference 2001*. Montreal, Quebec.
Kim, Y.T. and H. Sim. 2002. "Characteristics of Pulse Plasma Enhanced Atomic Layer Deposition of Tungsten Nitride Diffusion Barrier for Copper Interconnect" (Abstract). *IEIC Technical Report*. vol. 102, No. 178, pp. 115-118.
Elers, Kai-Erik, Ville Saanila, Pekka J. Soininen, Wei-Min Li, Juhana T. Kostamo, Suvi Haukka, Jyrki Juhanoja, and Wim F.A. Besling. 2002. "Diffusion Barrier Deposition on a Copper Surface by Atomic Layer Deposition" (Abstract). *Advanced Materials*. vol. 14, No. 13-14, pp. 149-153.
Peng, C.H., C.H. Hsieh, C.L. Huang, J.C. Lin, M.H. Tsai, M.W. Lin, C.L. Chang, Winston S. Shue, and M.S. Liang. 2002. "A 90nm Generation Copper Dual Damascene Technology with ALD TaN Barrier." *IEEE*. pp. 603-606.
Van der Straten, O., Y. Zhu, E. Eisenbraun, and A. Kaloyeros. 2002. "Thermal and Electrical Barrier Performance Testing of Ultrathin Atomic Layer Deposition Tantalum-Based Materials for Nanoscale Copper Metallization." *IEEE*. pp. 188-190.
Wu, Z.C., Y.C. Lu, C.C. Chiang, M.C. Chen, B.T. Chen, G.J. Wang, Y.T. Chen, J.L. Huang, S.M. Jang, and M.S. Liang. 2002. "Advanced Metal Barrier Free Cu Damascene Interconnects with PECVD Silicon Carbide Barriers for 90/65-nm BEOL Technology." *IEEE*. pp. 595-598.
Jul. 25, 2003. International Search Report for PCT/US02/24858.
Mar. 30, 2004. Written Opinion for PCT/US02/19062.
Apr. 9, 2004. Written Opinion for PCT/US02/19116.
Apr. 22, 2004. Office Action for U.S. Appl. No. 09/998,372, filed Nov. 30, 2001.
Apr. 28, 2004. Written Opinion for PCT/US02/19117.
Apr. 29, 2004. Written Opinion for PCT/US02/19061.
May 5, 2004. Office Action for U.S. Appl. No. 09/943,955, filed Aug. 31, 2001.
May 5, 2004. International Preliminary Examination Report for PCT/US01/27406.
May 28, 2004. Office Action for U.S. Appl. No. 09/943,383, filed Aug. 31, 2001.
Jun. 3, 2004. Office Action for U.S. Appl. No. 09/928,474, filed Aug. 14, 2001.
Jun. 23, 2004. Office Action for U.S. Appl. No. 10/686,589, filed Oct. 17, 2003.
Jun. 30, 2004. Office Action for U.S. Appl. No. 09/800,980, filed Mar. 8, 2001.
Jul. 12, 2004. Office Action for U.S. Appl. No. 10/173,108, filed Jun. 8, 2002.
Sep. 15, 2004. Office Action for U.S. Appl. No. 10/632,107, filed Aug. 1, 2003.
Sep. 29, 2004. Office Action for U.S. Appl. No. 09/363,966, filed Jul. 29, 1999.
Oct. 1, 2004. International Preliminary Examination Report for PCT Serial No. PCT/US03/23964.
Oct. 6, 2004. Office Action for U.S. Appl. No. 10/759,108, filed Jan. 20, 2004.
Oct. 12, 2004. International Preliminary Examination Report for PCT Serial No. PCT/US02/19061.
Nov. 17, 2004. Written Opinion for PCT/US01/27407.
IslamRaja, M. M., C. Chang, J. P. McVittie, M. A. Cappelli, and K. C. Saraswat. May/Jun. 1993. "Two Precursor Model for Low-Pressure Chemical Vapor Deposition of Silicon Dioxide from Tetraethylorthosilicate." *J. Vac. Sci. Technol. B*, vol. 11, No. 3, pp. 720-726.
Kim, Eui Jung and William N. Gill. Jul. 1994. "Analytical Model for Chemical Vapor Deposition of $SiO_2$ Films Using Tetraethoxysliane and Ozone" (Abstract). *Journal of Crystal Growth*, vol. 140, Issues 3-4, pp. 315-326.
Guo, R.S, A. Chen, C.L. Tseng, I.K. Fong, A. Yang, C.L. Lee, C.H. Wu, S. Lin, S.J. Huang, Y.C. Lee, S.G. Chang, and M.Y. Lee. Jun.

16-17, 1998. "A Real-Time Equipment Monitoring and Fault Detection System." *Semiconductor Manufacturing Technology Workshop*, pp. 111-121.

Lantz, Mikkel. 1999. "Equipment and APC Integration at AMD with Workstream." *IEEE* , pp. 325-327.

Jul. 15, 2004. Office Action for U.S. Appl. No. 10/172,977, filed Jun. 18, 2002.

Aug. 2, 2004. Office Action for U.S. Appl. No. 10/174,377, filed Jun. 18, 2002.

Aug. 9, 2004. Written Opinion for PCT Serial No. PCT/US02/19063.

Aug. 18, 2004. International Preliminary Examination Report for PCT Serial No. PCT/US02/19116.

Aug. 24, 2004. Office Action for U.S. Appl. No. 10/135,405, filed May 1, 2002.

Aug. 25, 2004. Office Action for U.S. Appl. No. 09/998,384, filed Nov. 30, 2001.

Sep. 9, 2004. Written Opinion for PCT Serial No. PCT/US02/21942.

Sep. 16, 2004. International Preliminary Examination Report for PCT Serial No. PCT/US02/24859.

US 6,150,664, 11/2000, Su (withdrawn)

* cited by examiner

TECHNIQUE FOR PROCESS-QUALIFYING A SEMICONDUCTOR MANUFACTURING TOOL USING METROLOGY DATA

CROSS REFERENCE TO RELATED APPLICATION

This application is related to and claims the priority of U.S. Provisional Application Ser. No. 60/491,974, filed Aug. 4, 2003, which is incorporated herein by reference.

FIELD OF THE INVENTION

The present invention relates generally to semiconductor manufacture. More particularly, the present invention relates to techniques for qualifying semiconductor manufacturing tools. Even more specifically, one or more embodiments of the present invention relate to techniques for qualifying a CMP tool using metrology data measured from a single wafer.

BACKGROUND OF THE INVENTION

In the fabrication of integrated circuits, numerous integrated circuits are typically constructed simultaneously on a single semiconductor wafer. The wafer is then later subjected to a singulation process in which individual integrated circuits are singulated (i.e., extracted) from the wafer.

At certain stages of this fabrication process, it is often necessary to polish a surface of the semiconductor wafer. In general, a semiconductor wafer can be polished to remove high topography, surface defects such as crystal lattice damage, scratches, roughness, or embedded particles of dirt or dust. This polishing process is often referred to as mechanical planarization (MP) and is utilized to improve the quality and reliability of semiconductor stations. In typical situations, these processes are usually performed during the formation of various devices and integrated circuits on the wafer.

The polishing process may also involve the introduction of a chemical slurry (e.g., an alkaline or acidic solution). This polishing process is often referred to as chemical mechanical planarization (CMP). Much like mechanical planarization processes, chemical mechanical polishing is widely used in semiconductor processing operations as a process for planarizing various process layers, e.g., silicon dioxide, which is formed upon a wafer comprised of a semiconducting material, such as silicon. Chemical mechanical polishing operations typically employ an abrasive or abrasive-free slurry distributed to assist in planarizing the surface of a process layer through a combination of mechanical and chemical actions (i.e., the slurry facilitates higher removal rates and selectivity between films of the semiconductor surface).

During the normal course of operation, any number of reasons may necessitate the qualification or re-qualification of these mechanical and chemical mechanical polishing tools. Generally speaking, qualification procedures constitute the process steps required to calibrate and otherwise prepare a tool for production or service (e.g., so that the devices produced by the tool meet minimum predetermined specification requirements, as dictated by the demands of the individual fabs and/or product lines). For example, due to normal wear, a polishing pad may no longer be fit for service, and may need to be replaced by a new pad. In these instances, the qualification procedure collects a number of qualification characteristics (e.g., using the metrology data)

measured during initial use of the new pad on sets of blanket or "test" wafers (i.e., wafers having only a thin film of unpatterned material). The qualification procedure then makes appropriate modifications to the tool recipe based on the measured qualification characteristics to ensure that future production runs comport with, for example, a number of minimum specification requirements. In a similar manner, a new tool (e.g., a tool beginning production of a new semiconductor product line) must also be qualified before it can be put into production.

Conventional methods for process-qualifying the above-described tools consume a large numbers of test wafers (approximately 10 to 15 test wafers) and require lengthy amounts of time. With regard to the large amount of time required, this is due to the nature of the stand-alone sensors and metrology devices (i.e., metrology devices that are separate from the tools) used to collect the required qualification characteristics. In particular, because the sensors are separate from the processing tools, in order to collect the qualification characteristics, a typical process first requires measuring preprocessing characteristics followed by physically moving a wafer into the processing tool, where the wafer is processed. After processing, the wafer is removed from the tool and returned to the metrology device, where post-processing characteristics are measured and used in conjunction with the preprocessing characteristics to obtain the characteristics used in qualifying the tool (i.e., the qualification characteristics).

With these conventional methods, the amount of time required to move the wafers back and forth between the tools and the metrology devices is significant. Furthermore, with tools having multiple components or chambers with each requiring qualification, it was more efficient to qualify the chambers in parallel, thus resulting in the consumption of additional wafers. To illustrate, the convention methods may use one wafer to qualify a first chamber or first tool component, a second wafer to qualify a second chamber or second tool component, and a third wafer to qualify a third chamber or third tool component.

In addition to the test wafers, conventional methods often require the testing of a "look-ahead" or patterned production wafer. The testing of these look ahead-wafers was used to ensure that the polishing process met specifications under actual production circumstances.

Recently, conventional in situ metrology devices have been able to eliminate the time required by stand-alone sensors to transfer wafers back and forth between the tools and the metrology devices. However, these conventional devices did not necessarily collect the qualification characteristics used to properly qualify a tool. For instance, conventional in situ metrology devices did not measure film thickness, which is used to qualify tools for, for example, nonuniformity and polishing rate. Consequently, conventional techniques were still required to qualify tools (such as polishing tools) requiring such measurements.

One of the disadvantages of conventional qualification procedures is the cost associated with the testing of these large amounts of blanket and test wafers. In addition to the cost of the test wafers, there is a significant time penalty associated with the qualification procedures. That is, the tools cannot be used to produce products during the qualification process. Furthermore, the processing of test wafers subtracts from the useful life of the polishing pads, since they have only a finite amount of polishing cycles before requiring a change.

Accordingly, increasingly efficient techniques for qualifying such polishing processes are needed. Specifically, what is required is a technique that greatly reduces the number of wafers required for properly qualifying a polishing process. In this manner, the cost and time associated with obtaining a production-ready polishing process may be minimized.

SUMMARY OF THE INVENTION

The present invention addresses the needs and the problems described above by providing a technique for process qualifying a semiconductor manufacturing tool using qualification characteristics measured from a reduced number of wafers (e.g., in at least some embodiments, a single wafer). In at least some embodiments, the technique commences during the processing of a wafer with the manufacturing tool. During processing, the technique involves using an in situ metrology device able to measure from the wafer one or more qualification characteristics required to properly qualify the tool (e.g., wafer thickness information). Thus, wafers need not be transferred from the tool in order to collect qualification characteristics. Subsequently, the manufacturing tool is qualified by adjusting one or more parameters of a recipe in accordance with the qualification characteristics measured from the wafer to target one or more manufacturing tool specifications.

In one or more parallel and at least somewhat overlapping embodiments, the tool to be qualified includes a bulk removal polishing platen, a copper clearing platen and a barrier removal polishing platen. In these cases, the technique involves transferring a wafer to each of the bulk removal polishing, copper clearing and barrier removal polishing platens, where qualification characteristics are measured during wafer processing. These platens are subsequently qualified by adjusting one or more parameters of a recipe associated with each platen in accordance with the qualification characteristics measured from the wafer, to target one or more platen specifications.

In one or more other parallel and at least somewhat overlapping embodiments, the technique involves measuring a defectivity from the wafer during processing. Subsequently, the technique qualifies the tool for detectivity by adjusting one or more parameters of the recipe in accordance with the defectivity measured during processing to target a defectivity specification.

BRIEF DESCRIPTION OF THE DRAWINGS

Various objects, features, and advantages of the present invention can be more fully appreciated as the same become better understood with reference to the following detailed description of the present invention when considered in connection with the accompanying drawings, in which.

DETAILED DESCRIPTION OF THE INVENTION

In accordance with at least some embodiments of the present invention, a technique is provided for process-qualifying a semiconductor manufacturing tool using the qualification characteristics from a reduced number of wafers (e.g., in at least some embodiments, a single wafer). Specifically, during processing of a wafer by the tool, the present invention contemplates measuring one or more qualification characteristics from the wafer using an in situ sensor or metrology device necessary for properly qualifying the tool. Subsequently, the manufacturing tool is qualified by adjusting one or more parameters of a recipe in accordance with the qualification characteristics measured from the wafer to target one or more manufacturing tool specifications.

Figure 1:
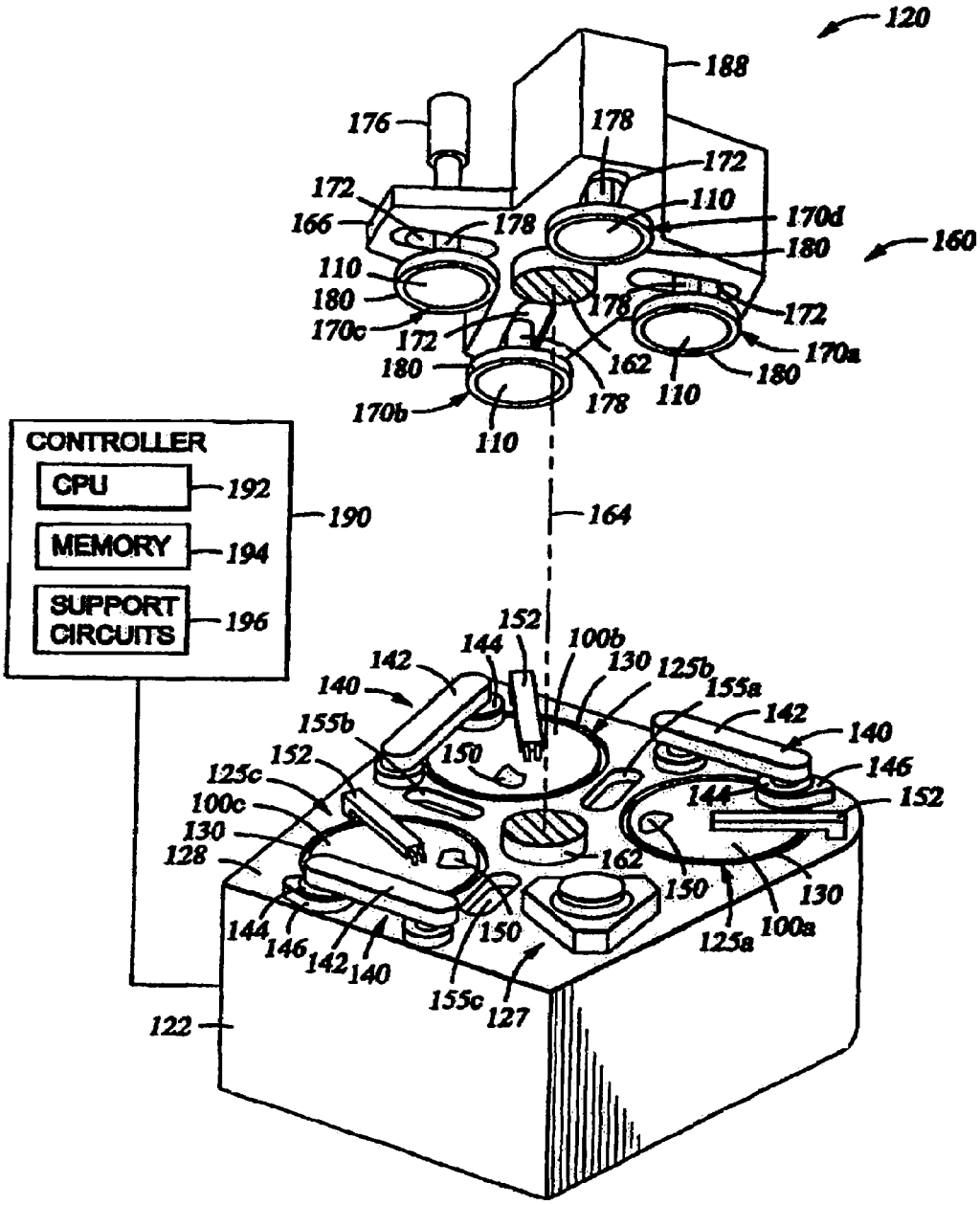
FIG. 1 is a perspective view of at least one example of a chemical mechanical planarization (CMP) apparatus.

FIG. 1 depicts at least one example of a chemical mechanical planarization (CMP) apparatus 120 utilizable for implementing at least some of the aspects of the present invention. Apparatus 120 includes a lower machine base 122 with a tabletop 128 mounted thereon and a removable outer cover (not shown). The tabletop 128 supports a series of polishing stations, including a first polishing station 125*a*, a second polishing station 125*b*, a third polishing station 125*c*, and a transfer station 127. The transfer station 127 serves multiple functions, including, for example, receiving individual wafers or substrates 110 from a loading apparatus (not shown), washing the wafers, loading the wafers into carrier heads 180, receiving the wafers 110 from the carrier heads 180, washing the wafers 110 again, and transferring the wafers 110 back to the loading apparatus.

A computer based controller 190 is connected to the polishing system or apparatus 120 for instructing the system to perform one or more processing steps on the system, such as polishing or qualification process on apparatus 120. The invention may be implemented as a computer program-product for use with a computer system or computer based controller 190. Controller 190 may include a CPU 192, which may be one of any form of computer processors that can be used in an industrial setting for controlling various chambers and subprocessors. A memory 194 is coupled to the CPU 192 for storing information and instructions to be executed by the CPU 192. Memory 194, may take the form of any computer-readable medium, such as, for example, any one or more of readily available memory such as random access memory (RAM), read only memory (ROM), floppy disk, hard disk, or any other form of digital storage, local or remote. In addition, support circuits 196 are coupled to the CPU 192 for supporting the processor in a conventional manner. As will be discussed in greater detail below in conjunction with FIG. 7, these circuits may include cache, power supplies, clock circuits, input/output circuitry and subsystems, and can include input devices used with controller 190, such as keyboards, trackballs, a mouse, and display devices, such as computer monitors, printers, and plotters.

A process, for example the qualification process described below, is generally stored in memory 194, typically as a software routine. The software routine may also be stored and/or executed by a second CPU (not shown) that is remotely located from the hardware being controlled by the CPU 192.

Each polishing station includes a rotatable platen 130 on which is placed a polishing pad 100*a*, 100*b*, and 100*c*. If wafer 110 is an eight-inch (200 millimeter) or twelve-inch (300 millimeter) diameter disk, then platen 130 and polishing pad 100 will be about twenty or thirty inches in diameter, respectively. Platen 130 may be connected to a platen drive motor (not shown) located inside machine base 122. For most polishing processes, the platen drive motor rotates platen 130 at thirty to two hundred revolutions per minute, although lower or higher rotational speeds may be used.

The polishing stations 125*a*-125*c* may include a pad conditioner apparatus 140. Each pad conditioner apparatus 140 has a rotatable arm 142 holding an independently rotating conditioner head 144 and an associated washing basin 146. The pad conditioner apparatus 140 maintains the condition of the polishing pad so that it will effectively polish the wafers. Each polishing station may include a conditioning station if the CMP apparatus is used with other pad configurations.

A slurry 150 containing a reactive agent (e.g., deionized water for oxide polishing) and a chemically-reactive catalyzer (e.g., potassium hydroxide for oxide polishing) may be supplied to the surface of polishing pad 100 by a combined slurry/rinse arm 152. If polishing pad 100 is a standard pad, slurry 150 may also include abrasive particles (e.g., silicon dioxide for oxide polishing). Typically, sufficient slurry is provided to cover and wet the entire polishing pad 100. Slurry/rinse arm 152 includes several spray nozzles (not shown) which provide a high-pressure rinse of polishing pad 100 at the end of each polishing and conditioning cycle. Furthermore, several intermediate washing stations 155*a*, 155*b*, and 155*c* may be positioned between adjacent polishing stations 125*a*, 125*b*, and 125*c* to clean wafers as they pass from one station to another.

In at least one embodiment of the present invention, the first polishing station 125*a* has a first pad 100*a* disposed on platen 130 for removing bulk copper-containing material disposed on the wafer (i.e., a bulk removal polishing platen). The second polishing station 125*b* has a second pad 100*b* disposed on a platen 130 for polishing a wafer to remove residual copper-containing material disposed on the wafer (i.e., a copper clearing platen). A third polishing station 125*c* having a third polishing pad 100*c* may be used for a barrier removal polishing process following the two-step copper removal process (i.e., a barrier removal polishing platen).

A rotatable multi-head carousel 160 is positioned above the lower machine base 122. Carousel 160 includes four carrier head systems 170*a*, 170*b*, 170*c*, and 170*d*. Three of the carrier head systems receive or hold the wafers 110 by pressing them against the polishing pads 100*a*, 100*b*, and 100*c*, disposed on the polishing stations 125*a*-125*c*. One of the carrier head systems 170*a*-170*d* receives a wafer 110 from and delivers a wafer 110 to the transfer station 127. The carousel 160 is supported by a center post 162 and is rotated about a carousel axis 164 by a motor assembly (not shown) located within the machine base 122. The center post 162 also supports a carousel support plate 166 and a cover 188.

The four carrier head systems 170*a*-170*d* are mounted on the carousel support plate 166 at equal angular intervals about the carousel axis 164. The center post 162 allows the carousel motor to rotate the carousel support plate 166 and orbit the carrier head systems 170*a*-170*d* about the carousel axis 164. Each carrier head system 170*a*-170*d* includes one carrier head 180. A carrier drive shaft 178 connects a carrier head rotation motor 176 to the carrier head 180 so that the carrier head 180 can independently rotate about its own axis. There is one carrier drive shaft 178 and motor 176 for each head 180. In addition, each carrier head 180 independently oscillates laterally in a radial slot 172 formed in the carousel support plate 166.

The carrier head 180 performs several mechanical functions. Generally, the carrier head 180 holds the wafer 110 against the polishing pads 100*a*, 100*b*, and 100*c*, evenly distributes a downward pressure across the back surface of the wafer 110, transfers torque from the drive shaft 178 to the wafer 110, and ensures that the wafer 110 does not slip out from beneath the carrier head 80 during polishing operations.

A description of a similar apparatus may be found in U.S. Pat. No. 6,159,079, the entire disclosure of which is incorporated herein by reference. A commercial embodiment of a CMP apparatus could be, for example, any of a number of processing stations or devices offered by Applied Materials, Inc. of Santa Clara, Calif. including, for example, any number of the Mirramesa™ and Reflexion™ line of CMP devices. Also, while the device depicted in FIG. 1 is implemented to perform polishing processes and includes any polishing stations, it is to be understood that the concepts of the present invention may be utilized in conjunction with various other types of semiconductor manufacturing processes and processing resources including for example non-CMP devices, etching tools, deposition tools, plating tools, etc. Other examples of processing resources include polishing stations, chambers, and/or plating cells, and the like.

Figure 2:
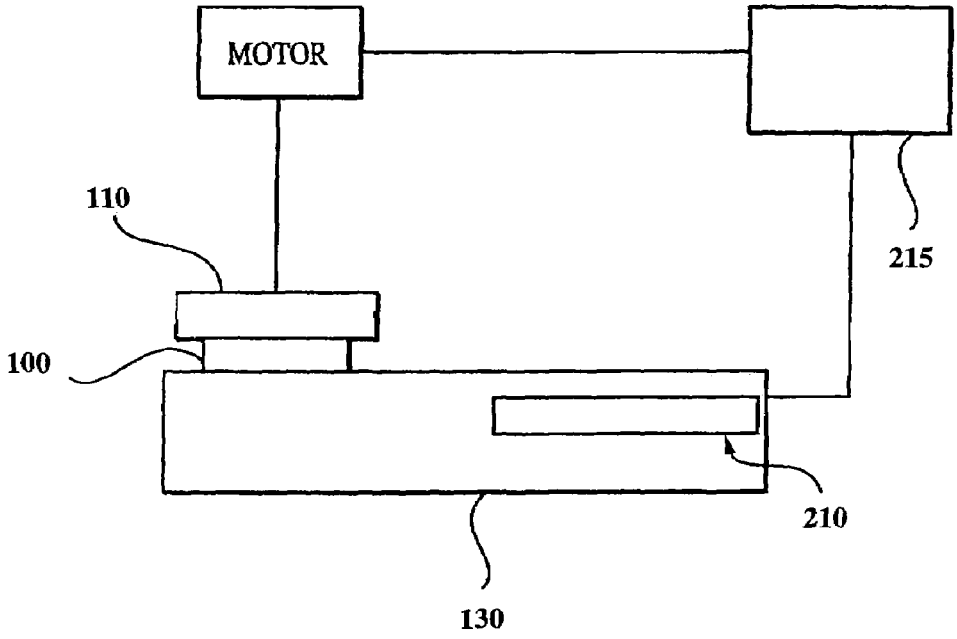
FIG. 2 depicts a block diagram of a metrology system that can be used in conjunction with the apparatus FIG. 1.

FIG. 2 depicts a block diagram of a metrology system of a single polishing station (e.g., any one or combination of stations 125*a*-125*c*) of FIG. 1 that may be used in conjunction with the qualification process of the present invention. More specifically, the metrology system includes an in situ sensor 210 and a control system 215. In situ sensor 210 may be utilized in real time to measure one or more qualification characteristics during execution of the polishing steps of a qualification process, as well as during the polishing steps of an actual production process. As a result, wafers are not required to be removed from the polishing station in order to collect metrology data. These qualification characteristics in turn may be used to qualify a polishing station (e.g., stations 125*a*-125*c*) of the apparatus of FIG. 1.

In situ sensor 210 may include a wafer thickness measuring device for measuring a topography of the wafer face during polishing. By being able to measure thickness in real-time, in situ sensor 210 is capable of providing a number of qualification characteristics used to properly qualify a semiconductor manufacturing tool. Specific types of in Situ sensors include laser interferometer measuring devices, which employ interference of light waves for purposes of measurement. One example of such an in situ sensor suitable for use with the present invention includes the In Situ Removal Monitor (ISRM) offered by Applied Materials, Inc. of Santa Clara, Calif. Similarly, in situ sensor 210 may include devices for measuring capacitance changes or eddy currents (such as the iScan monitor, also offered by Applied Materials, Inc. of Santa Clara, Calif.), optical sensors (such as the Nanospec series of metrology devices offered by Nanometrics of Milpitas, Calif. or Nova 2020 offered by Nova Measuring Instruments, Ltd. of Rehovot, Israel), devices for measuring frictional changes, and acoustic mechanisms for measuring wave propagation (as films and layers are removed during polishing), all of which may be used to detect thickness in real time. Furthermore, it should be noted that at least some embodiments of the present invention contemplate implementing an in situ sensor capable of measuring both oxide and copper layers. Other examples of wafer property measuring devices contemplated by at least some embodiments of the present invention include integrated CD (critical dimension) measurement tools, and tools capable of performing measurements for dishing, erosion and residues, and/or particle monitoring, etc.

Any combination of the above sensors may be utilized with the present invention. For instance, in the example of FIG. 1, a capacitance or eddy current measuring sensor may be utilized in conjunction with bulk removal polishing station 125*a*, a light wave measuring sensor may be utilized in conjunction with copper clearing station 125*b*, and an optical sensor may be utilized in conjunction with barrier removal polishing station 125*c*.

Referring back to FIG. 2, in accordance with at least some of the embodiments of the present invention, control system 215 implements a qualification process for controlling each of the steps required to attain a number of predetermined manufacturing specifications. Specifically, as will be discussed in greater detail below, during the qualification process of the present invention, control system 215 initially directs in situ sensor 210 to gather each of the qualification characteristics required to qualify apparatus 120 from a single wafer. Control system 215 subsequently modifies any number of recipe parameters in order to attain a number of manufacturing specifications (determined according to fab or product demands) associated with apparatus 120. Thus, control system 215 is operatively coupled to, in addition to in situ sensor 210, components of apparatus 120 to monitor and control a number of qualification and manufacturing processes.

As mentioned above, in situ sensor 210 may be used to obtain various qualification characteristics, for example during qualification procedures, which may be compared against tool specifications to measure the efficiency of the process. Examples of such characteristics are the removal rate of the film material to be removed from the wafer, the uniformity or nonuniformity in the material removal, the defectivity, and other similar and analogous metrics. These and other characteristics are indicators of the quality of the polishing process. The removal rate is mainly used to determine the polishing time of product wafers. The nonuniformity directly affects the global planarity across the wafer surface, which becomes more important as larger wafers are used in the fabrication of devices. The defectivity indicates the number of defects occurring due to for example scratches in the wafer. Each of the above depends on and may be affected by the polishing parameters of the process recipe. Thus, parameters such as the applied pressure or downward force, the speed of the polishing table, the speed of the wafer carrier, the slurry composition, the slurry flow, and others, may be modified to adjust the characteristics, in an attempt to satisfy minimum tool specification levels.

Figure 3:
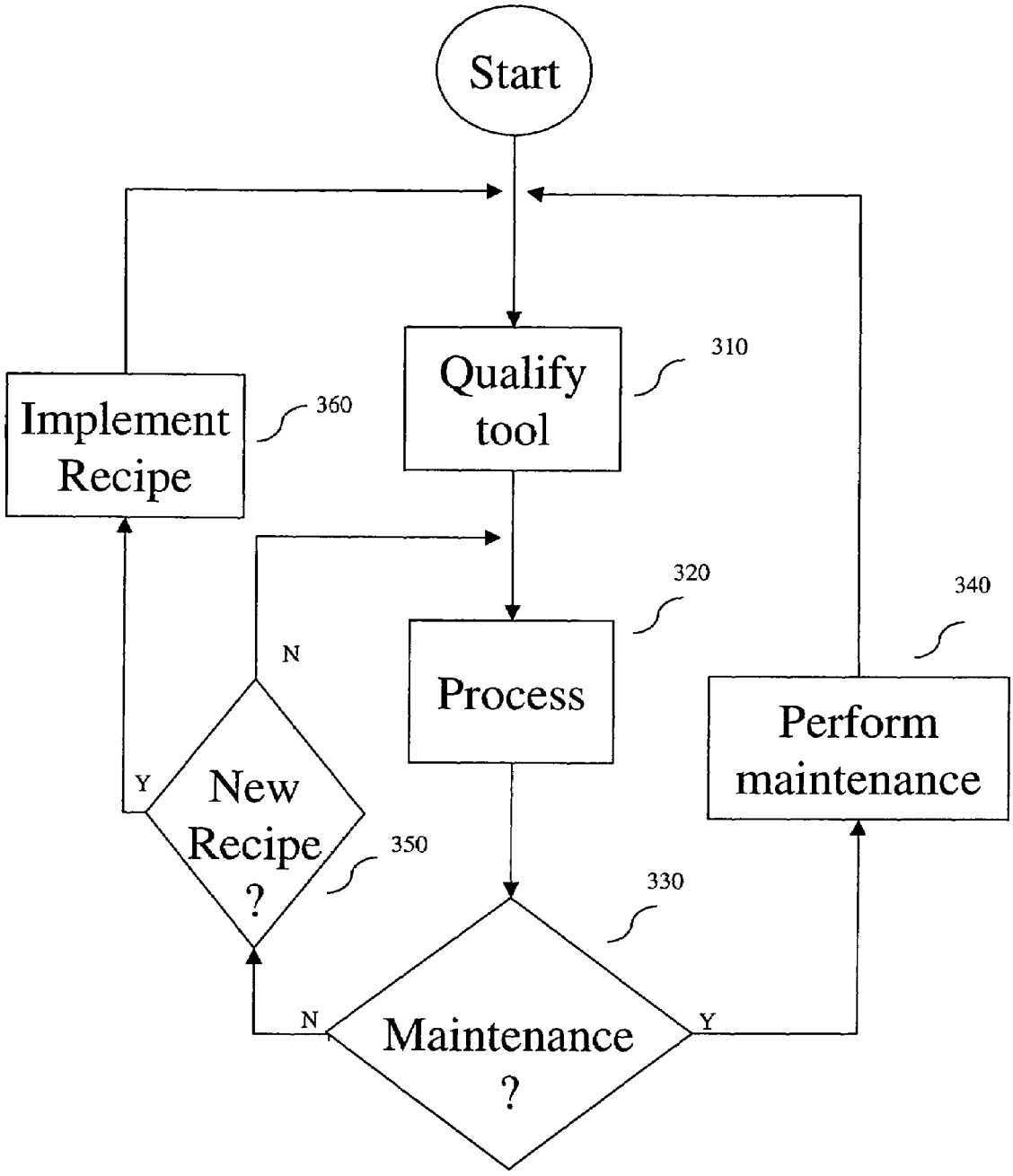
FIG. 3 illustrates at least one example of the operation of the apparatus of FIG. 1, during which the qualification or requalification process of at least some embodiments of the present invention may be utilized.

FIG. 3 illustrates at least one example of operation of a polishing tool (e.g., tool 120 of FIG. 1), during which the tool may require qualification or requalification according to the concepts of the present invention. As discussed above, before a tool may be placed on-line and into production, it must be qualified to meet minimum specification levels. Thus, before production commences on the tool, it is first qualified (STEP 310). After qualification, the tool may begin processing wafers (STEP 320). For example, processing may be directed according to a tool recipe downloaded onto the tool.

During the normal course of operation, the tool may require routine forms of maintenance. For example, the polishing pads and other components of the tool may need to be replaced due to normal wear. In some cases, the tool determines whether maintenance is necessary by identifying process results that are no longer within minimum specifications (e.g., process drifts). In other cases, the tools may be serviced periodically. In any case, once it is determined that maintenance is necessary (STEP 330), the required maintenance is performed (STEP 340). For example, the worn polishing pads or other parts may be replaced.

In other instances, a new tool recipe for controlling the tool may be implemented (STEP 350). For example, the tool may be directed to produce another product. Similarly, different wafers and substrates, with different characteristics, may be delivered for processing by the tool. Both of these cases (and others) require the implementation of a new recipe. Whatever the case, the new recipe is downloaded onto the tool (STEP 360).

In each of the above (and other) situations, the tool must be requalified before production can recommence (STEP 310). As discussed, the qualification procedure ensures that the results of processing by the tool meet a number of minimum specification levels. Once qualified, the tool recommences the processing of wafers (STEP 320).

Figure 4:
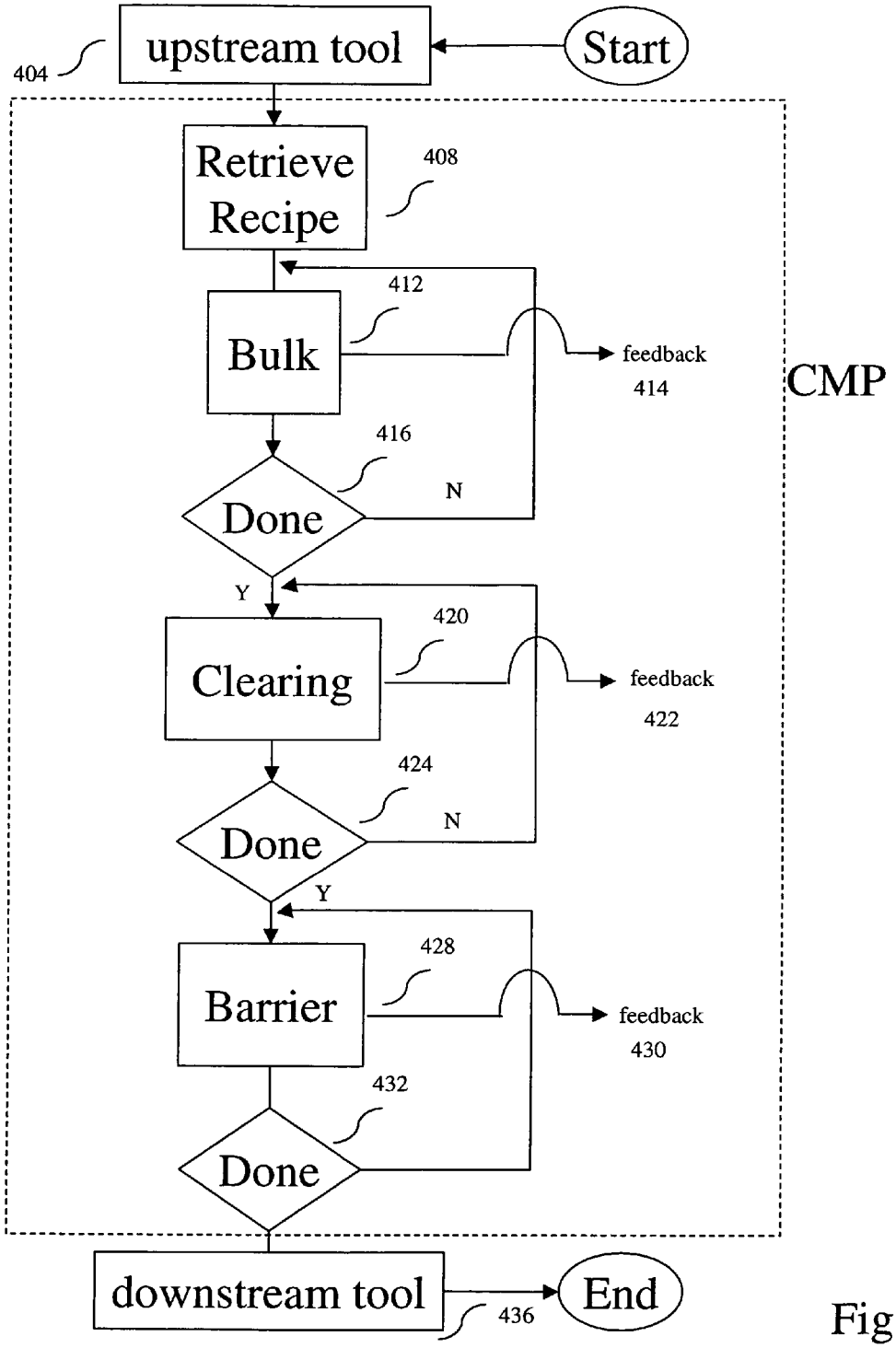
FIG. 4 illustrates at least one example of a polishing process for controlling the apparatus of FIG. 1.

As discussed, the qualification procedure of the present invention is utilizable with a multi-step polishing process for removing conductive materials and conductive material residues from a wafer or substrate surface using one or more polishing pads. One example of such a polishing processes is described with reference to FIG. 4. Initially, a wafer is transferred from an upstream tool to the polishing tool (STEP 404). In the example of FIG. 1, the wafer may be transferred from an electrochemical plating (ECP) tool to bulk removal polishing platen 125*a* of tool 120. Subsequently, a tool recipe for controlling the polishing tool is downloaded and implemented on the tool (STEP 408).

At the bulk removal polishing platen, a first polishing composition is used with a first polishing pad to remove bulk copper containing material from the wafer surface to substantially planarize the bulk copper containing material (STEP 412). Bulk removal polishing continues until a predetermined amount of copper is removed from the wafer as determined by, for example, an eddy current or capacitance endpoint sensor (or any other analogous or suitable sensor) (STEP 416). In addition, feedback data may be collected by the sensor for use in optimizing future runs (STEP 414). From there, the wafer is delivered to a second or copper clearing polishing platen (e.g., platen 125*b*).

At the copper clearing platen, a second polishing composition is used with a second polishing pad to remove remaining residual copper containing material (STEP 420). The residual copper containing material removal process terminates when the underlying barrier layer has been reached (STEP 424). This can be determined by, for example, an optical or light-sensing metrology device. In addition, the metrology device may be used to collect feedback data for use in optimizing future runs (STEP 422). Subsequently, the wafer is transported to a third or barrier removal polishing platen (e.g., platen 125*c*).

At the barrier removal polishing platen, a third polishing composition is used with a third polishing pad to remove the barrier layer (STEP 428). This layer is typically formed on the wafer surface above a dielectric layer. Polishing continues until, for example, the barrier layer, and in some cases a portion of the underlying dielectric, has been removed (STEP 432). This can be determined by, for example, an optical sensor and the like. Afterwards, the wafer may be transferred to a cleaning module or subjected to an in situ cleaning process to remove surface defects, or to some other downstream tool for further processing (STEP 436).

As discussed above, maintenance (e.g., pad replacement at any or all of the above-described platens) requires the requalification of the polishing tool. In accordance with at least some of the concepts of the present invention, and as will be discussed in greater detail below, the in situ metrology devices (i.e., in situ sensors) described above for collecting endpoint and feedback data may be utilized to collect substantially all of the qualification characteristics, during a qualification procedure, required to properly qualify any or all of the platens of the polishing tool, from a single wafer. Specifically, at least some of the embodiments of the present invention contemplate using a single patterned or production wafer as the source of substantially all of the metrology wafer data required to properly qualify a tool. In other embodiments, other wafers, such as a single blanket wafer may be used. This is the case because use of the in situ metrology devices or sensors allows measuring of the qualification techniques without removal of the wafer from the tool. As a result, the present invention greatly reduces the time and costs associated with qualifying a polishing tool.

Figure 5:
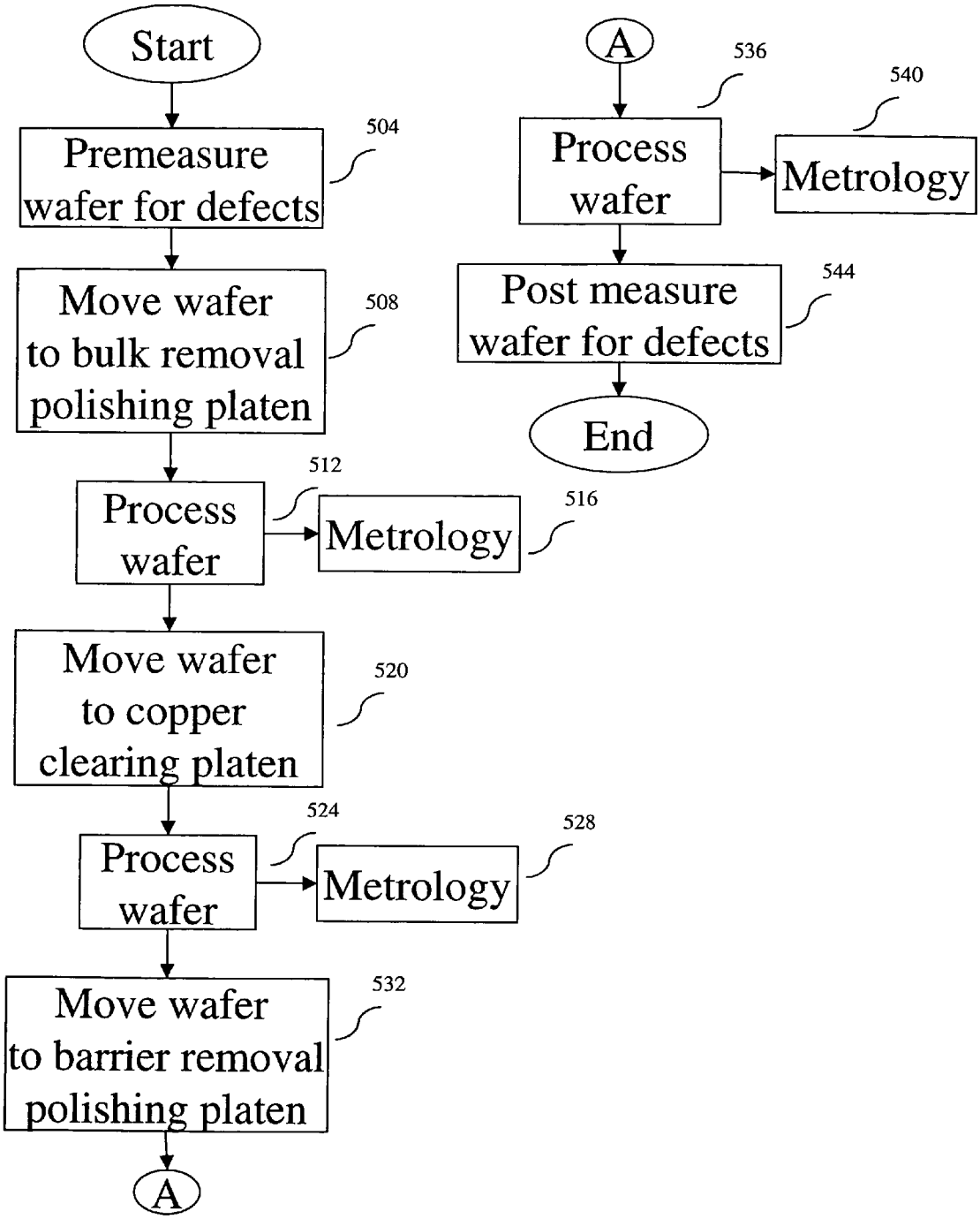
FIG. 5 illustrates at least one example of a process utilizable for collecting the qualification characteristics required for use with the qualification process of the present invention.

Referring now to FIG. 5, at least one example of a process utilizable for collecting the necessary qualification characteristics is described. As discussed, the qualification characteristics collected from the processing of a single wafer is sufficient to properly qualify the polishing tool. Initially, after receiving the wafer at tool 120, the wafer is premeasured for defects (STEP 504). Specifically, the number of defects existing on the wafer may be measured using an optical metrology device or the like. For example, the Compass laser-sensing device offered by Applied Materials may be utilized.

Subsequently, the wafer is positioned on bulk removal polishing platen 125*a* (STEP 508). Bulk copper containing materials are then removed by polishing the surface of the wafer (STEP 512). In conjunction with the bulk removal polishing procedure, a sensor or other metrology device (e.g., in situ sensor 210) collects metrology data from the wafer (STEP 516). In particular, the sensor may be implemented to collect, for example, the thickness of the bulk copper material before and after polishing, as well as a polishing time and the level of current in the material during processing. In addition, the data measured by the metrology device also dictates when to terminate the bulk removal polishing process. For example, in the case of an eddy current sensor, which is capable of using current changes to detect changes in film characteristics (e.g., changes in film characteristics, such as thickness, directly affect a current), processing terminates when the measured current drops below or rises above a predetermined level. As will be discussed in greater detail below, this metrology data is collected and analyzed for purposes of qualifying bulk removal polishing platen 125*a* of polishing tool 120.

After the bulk removal polishing process has been completed, the wafer is positioned on copper clearing platen 125*b* (STEP 520). At the copper clearing platen, residual copper containing materials are removed by polishing the surface of the wafer (STEP 520). In conjunction with the copper clearing procedure, a sensor such as the ISRM collects metrology data from the wafer (STEP 528). In particular, the sensor may be implemented to collect, for example, the polishing time required to clear the copper from the wafer and the level of light intensity in the material during polishing. As with the bulk removal polishing platen, the data measured by this metrology device also dictates when to terminate the copper clearing process. For example, in the case of an optical sensor, which is capable of detecting changes in light intensity (e.g., a change from copper film to a barrier material directly affects light intensity), processing terminates when the intensity of the measured light drops below or rises above a predetermined level. As will be discussed in greater detail below, this metrology data is collected and analyzed for purposes of qualifying copper clearing platen 125*b* of polishing tool 120.

After the copper clearing process has been completed, the wafer is positioned on a barrier removal polishing platen (STEP 532). At the barrier removal polishing platen, barrier layer materials are removed by polishing the surface of the wafer (STEP 536). In conjunction with this procedure, a sensor, such as an optical sensor or the like, collects metrology data from the wafer (STEP 540). In particular, the sensor may be implemented to collect, for example, the polishing time required to clear the copper from the wafer and the level of light intensity in the material during polishing. As with the previous platens, the data measured by this metrology device also dictates when to terminate the barrier removal polishing process. For example, in the case of an optical sensor, which is capable of detecting a change in light intensity (e.g., a change from barrier material to a dielectric material directly affects light intensity), processing terminates when the intensity of the measured light drops below or rises above a predetermined level. As will be discussed in greater detail below, this metrology data is collected and analyzed for purposes of qualifying barrier removal polishing platen 125*c* of polishing tool 120.

After wafer polishing has been completed, the wafer is delivered to a wafer defectivity sensor, where the wafer is measured for defects (STEP 544). For example, the wafer may be measured for its total number of detects using the metrology device utilized in STEP 504, as described above.

In accordance with at least some of the concepts of the present invention, the metrology data gathered from a single wafer during the process described in FIG. 5 (STEPS 504, 516, 528, 540, and 544) constitutes substantially all of the qualification characteristics required to properly qualify a polishing tool. One example of a process that utilizes this data to properly qualify a polishing tool is depicted in FIGS. 6*a* and 6*b*.

Figure 6A:
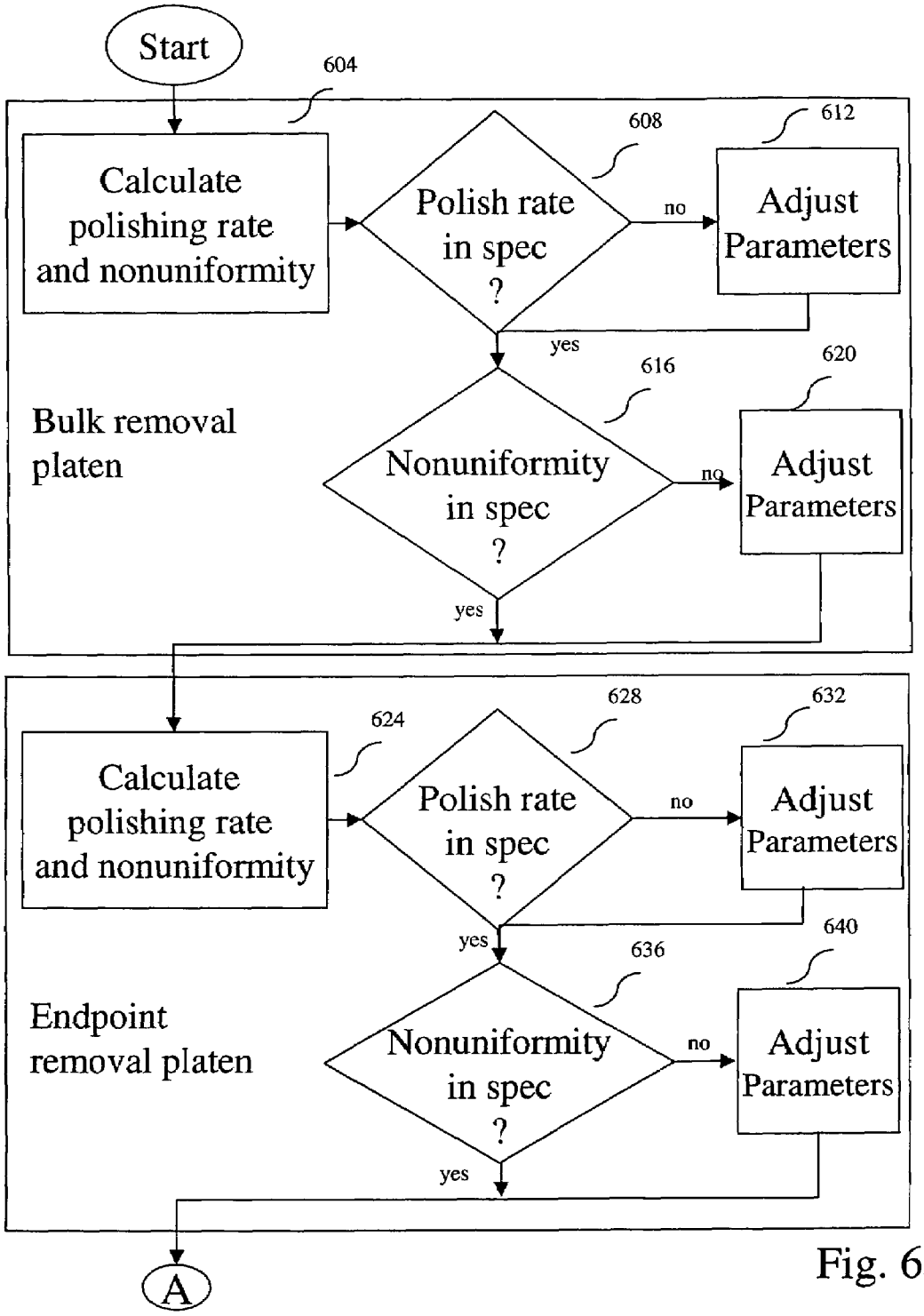
FIGS. 6*a* and 6*b* illustrate at least one example of a process which utilizes the qualification characteristics from a single wafer to properly qualify a polishing tool.
Figure 6B:
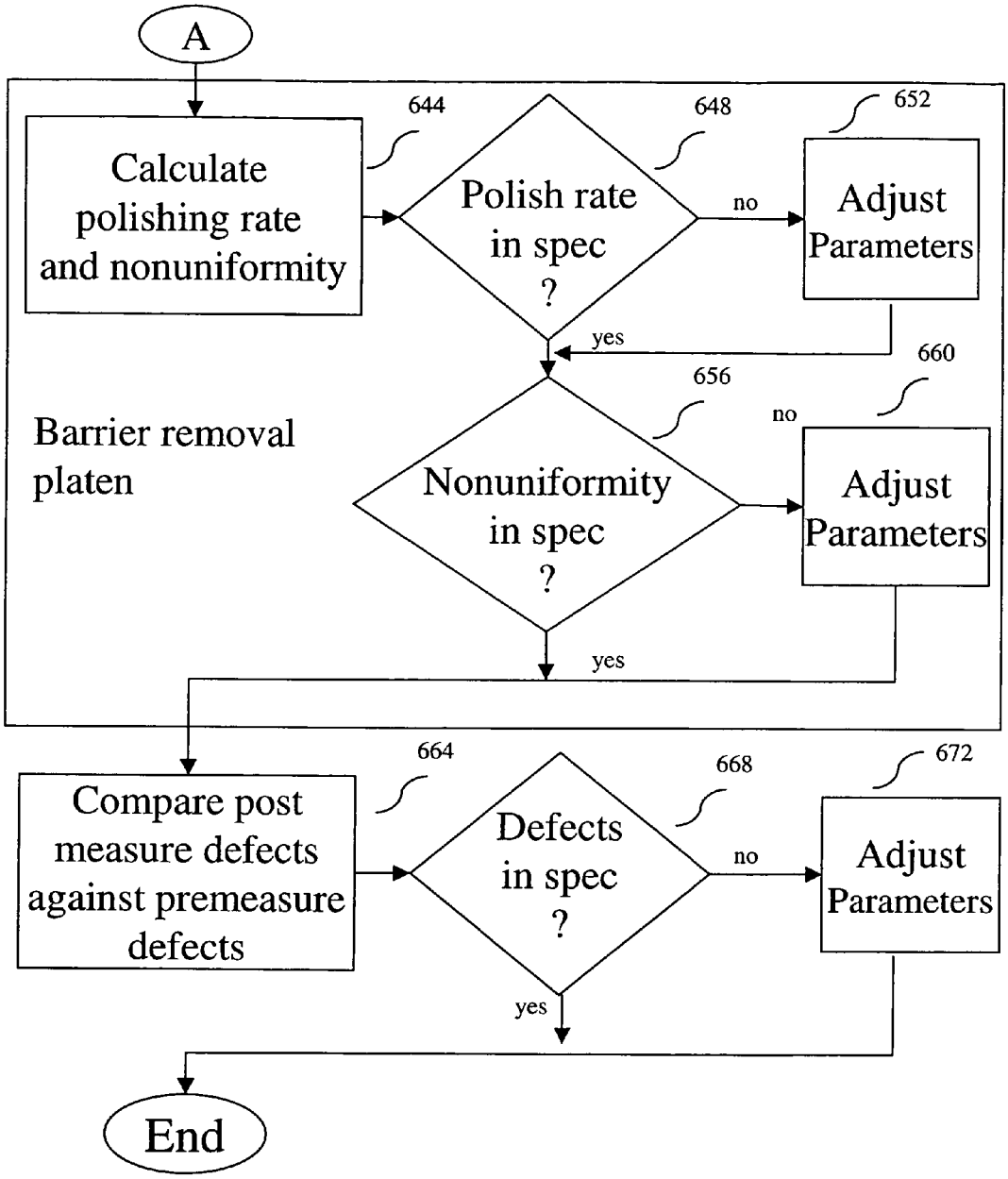

Referring to FIGS. 6*a* and 6*b*, processing commences with the calculation of each of the qualification characteristics required to properly qualify bulk removal polishing platen 125*a*. In at least some embodiments, the raw metrology data measured during processing of the test wafer at the bulk removal polishing platen constitutes the required qualification data. In other cases, a step of processing must be performed to convert the raw metrology data into usable form. For example, thickness data at several points may need to be averaged before use. In at least some embodiments of the present invention, the qualification characteristics may include a polishing rate and a nonuniformity (although other qualification characteristics are possible). In these cases, the process calculates the polishing rate and nonuniformity of the platen (STEP 604) using the metrology data measured during processing of the test wafer at bulk removal polishing platen 125*a* (e.g., STEP 516). Specifically, the process utilizes the starting thickness of a bulk material, the ending thickness of the material, and the time required to reach the ending thickness to obtain the polishing rate of the platen. Similarly, the measured metrology data (i.e., the film thickness at a number of predetermined points across the wafer) may be utilized to generate a wafer profile. This profile, in turn may be used to obtain the nonuniformity of the wafer resulting from the bulk removal polishing process.

From there, the process compares the qualification characteristics against the minimum tool specifications. Thus, the process first compares the polishing rate against a polishing rate specification for bulk removal polishing platen 125*a* (STEP 608). If the polishing rate is not within specification, appropriate adjustments are made to the tool recipe so that future runs (i.e., actual production runs) are within specification limits (STEP 612). For example if the polishing rate exceeds the specification rate, the bulk removal polishing platen pressure may be reduced. After qualifying bulk removal polishing platen 125*a* for its polishing rate, the process next compares the nonuniformity against a specification nonuniformity for the bulk removal polishing platen (STEP 616). If the nonuniformity is not within specification, appropriate adjustments are made to the tool recipe so that future runs (i.e., actual production runs) are within specification limits (STEP 620). For example, the polishing pressures applied by various zones in a polishing head to the wafer may be adjusted. Similarly, the slurry composition used in the bulk removal polishing process may be adjusted. As known by those of ordinary skill in the art, the exact adjustments made by the process to comport with tool specifications may be determined in view of, for example, design of experiments (DOE) information and other similar data. After qualifying bulk removal polishing platen 125*a* for nonuniformity, qualification shifts to copper clearing platen 125*b*.

Processing continues with the calculation of each of the qualification characteristics necessary to properly qualify copper clearing platen 125*b*. As with the bulk removal polishing qualification procedure, the qualification characteristics may take the form of either raw or processed data. In at least some embodiments of the present invention, the qualification characteristics may include a polishing rate and a nonuniformity (although other qualification characteristics are possible). In these cases, the process uses the metrology data measured during processing of the test wafer at copper clearing platen 125*b* (e.g., STEP 528) to calculate the polishing rate and nonuniformity of the platen (STEP 624). Specifically, the process utilizes the starting thickness of the copper residue material (as measured, e.g., at the end of the bulk removal qualification process) and the time required to clear the remaining material to determine polishing rate of the platen. The change in light intensity taken as a function of time (measured by the copper clearing platen metrology device) may be utilized to determine the nonuniformity of the wafer resulting from processing by copper clearing platen 125*b*.

Subsequently, the process compares the qualification characteristics against minimum tool specifications. Thus, the process compares the polishing rate against a polishing rate specification for the copper clearing platen 125*b* (STEP 628) and the nonuniformity against the nonuniformity specification for the copper clearing platen 125*b* (STEP 636). If either of these qualification characteristics is not within specification, appropriate adjustments may be made to the tool recipe so that future runs (i.e., actual production runs) are within specification limits (STEP 632 and STEP 640). After qualifying copper clearing platen 125*b*, qualification shifts to barrier removal polishing platen 125*c*.

Processing continues with the calculation of each of the qualification characteristics necessary to properly qualify barrier removal polishing platen 125*c*. As with the above, the qualification characteristics may take the form of either raw or processed data. In at least some embodiments of the present invention, the qualification characteristics may include a polishing rate and a nonuniformity (although other qualification characteristics are possible). In these cases, the process uses the metrology data measured during processing of the test wafer at barrier removal polishing platen 125*c* (e.g., STEP 540) to calculate the polishing rate and nonuniformity of the platen (STEP 644). Specifically, the process utilizes the starting thickness of the barrier material (as measured, e.g., at the end of the copper clearing qualification process), the remaining thickness of a dielectric layer (i.e., the layer underlying the barrier layer), and the total polishing time to determine the polishing rate of the platen. Similarly, the process measures the thickness of the wafer at a predetermined number of points (e.g., 15-20 points) to determine the nonuniformity of the wafer resulting from barrier removal polishing platen 125*c*.

Subsequently, the process compares the qualification characteristics against minimum tool specifications. Thus, the process compares the polishing rate against a polishing rate specification for barrier removal polishing platen 125*c* (STEP 648) and the nonuniformity against the nonuniformity specification for barrier removal polishing platen 125*c* (STEP 656). If either of these qualification characteristics is not within specification, appropriate adjustments may be made to the tool recipe so that future runs (i.e., actual production runs) are within specification limits (STEP 652 and STEP 660). After qualifying barrier removal polishing platen 125*c*, qualification shifts to defectivity.

To qualify the polishing tool for defectivity, the process compares the number of defects measured before the polishing (e.g., STEP 504) against the number of defects after polishing (e.g., STEP 544) (STEP 664), and determines whether the change in the number of defects is within specification (STEP 668). If the change in the number of defects is within specification, processing ends. However, if the change in the number of defects is not within specification, appropriate adjustments may be made to the tool recipe so that future runs (i.e., actual production runs) are within specification limits (STEP 672). For example, the chemical composition of the slurry used in one of the polishing processes may be adjusted. In other embodiments, to qualify the polishing tool for defectivity, instead of analyzing the change in the number of defects, the number of defects measured after polishing (e.g., STEP 544) is compared against a specification limit or other requirement.

Figure 7:
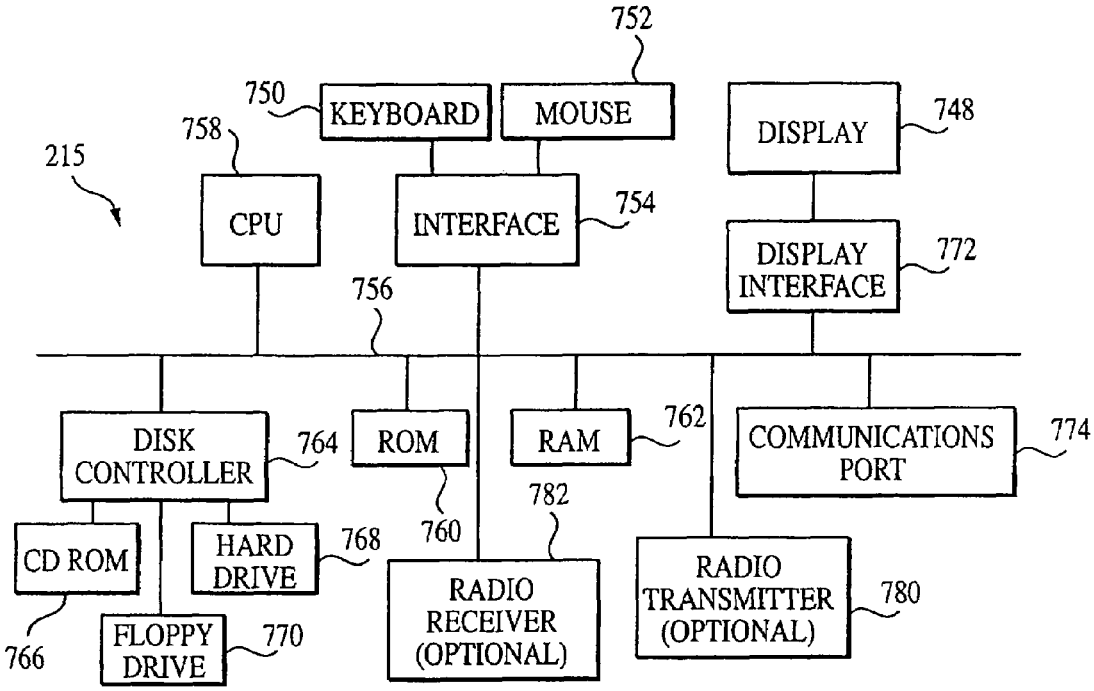
FIG. 7 is a high-level block diagram depicting at least some of the aspects of computing devices contemplated as part of and for use with at least some embodiments of the present invention.

As discussed above, the qualification process of the present invention may be implemented in any computer system or computer-based controller. One example of such a system is described in greater detail below with reference to FIG. 7. Specifically, FIG. 7 illustrates a block diagram of one example of the internal hardware of control system 215 of FIG. 2, examples of which include any of a number of different types of computers such as those having Pentium™ based processors as manufactured by Intel Corporation of Santa Clara, Calif. A bus 756 serves as the main information link interconnecting the other components of system 215. CPU 758 is the central processing unit of the system, performing calculations and logic operations required to execute the processes of the instant invention as well as other programs. Read only memory (ROM) 760 and random access memory (RAM) 762 constitute the main memory of the system. Disk controller 764 interfaces one or more disk drives to the system bus 756. These disk drives are, for example, floppy disk drives 770, or CD ROM or DVD (digital video disks) drives 766, or internal or external hard drives 768. CPU 758 can be any number of different types of processors, including those manufactured by Intel Corporation or Motorola of Schaumberg, Ill. The memory/storage devices can be any number of different types of memory devices such as DRAM and SRAM as well as various types of storage devices, including magnetic and optical media. Furthermore, the memory/storage devices can also take the form of a transmission.

A display interface 772 interfaces display 748 and permits information from the bus 756 to be displayed on display 748. Display 748 is also an optional accessory. Communications with external devices such as the other components of the system described above, occur utilizing, for example, communication port 774. For example, port 774 may be interfaced with a bus/network linked to CMP device 20. Optical fibers and/or electrical cables and/or conductors and/or optical communication (e.g., infrared, and the like) and/or wireless communication (e.g., radio frequency (RF), and the like) can be used as the transport medium between the external devices and communication port 774. Peripheral interface 754 interfaces the keyboard 750 and mouse 752, permitting input data to be transmitted to bus 756. In addition to these components, the control system also optionally includes an infrared transmitter 778 and/or infrared receiver 776. Infrared transmitters are optionally utilized when the computer system is used in conjunction with one or more of the processing components/stations that transmits/receives data via infrared signal transmission. Instead of utilizing an infrared transmitter or infrared receiver, the control system may also optionally use a low power radio transmitter 780 and/or a low power radio receiver 782. The low power radio transmitter transmits the signal for reception by components of the production process, and receives signals from the components via the low power radio receiver.

Figure 8:
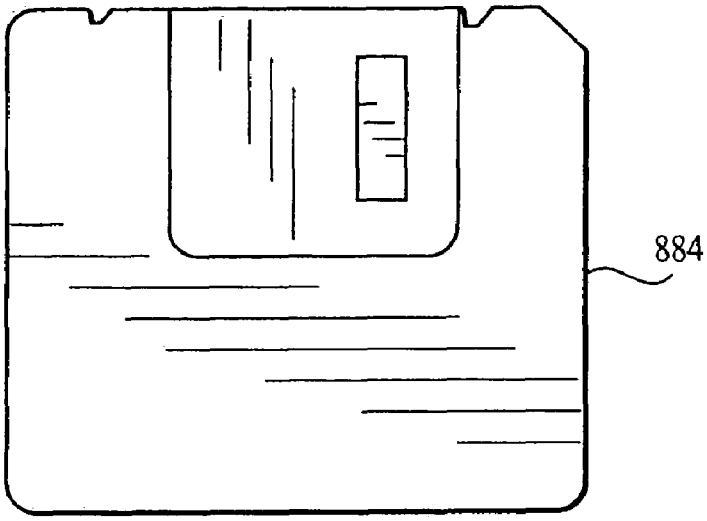
FIG. 8 illustrates one example of a memory medium which may be used for storing a computer implemented process of at least some embodiments of the present invention.

FIG. 8 is an illustration of an exemplary computer readable memory medium 884 utilizable for storing computer readable code or instructions including the model(s), recipe (s), etc). As one example, medium 884 may be used with disk drives illustrated in FIG. 7. Typically, memory media such as floppy disks, or a CD ROM, or a digital video disk will contain, for example, a multi-byte locale for a single byte language and the program information for controlling the above system to enable the computer to perform the functions described herein. Alternatively, ROM 760 and/or RAM 762 can also be used to store the program information that is used to instruct the central processing unit 758 to perform the operations associated with the instant processes. Other examples of suitable computer readable media for storing information include magnetic, electronic, or optical (including holographic) storage, some combination thereof, etc. In addition, at least some embodiments of the present invention contemplate that the computer readable medium can be a transmission.

Embodiments of the present invention contemplate that various portions of software for implementing the various aspects of the present invention as previously described can reside in the memory/storage devices.

In general, it should be emphasized that the various components of embodiments of the present invention can be implemented in hardware, software, or a combination thereof. In such embodiments, the various components and steps would be implemented in hardware and/or software to perform the functions of the present invention. Any presently available or future developed computer software language and/or hardware components can be employed in such embodiments of the present invention. For example, at least some of the functionality mentioned above could be implemented using C or C++ programming languages.

It is also to be appreciated and understood that the specific embodiments of the invention described hereinbefore are merely illustrative of the general principles of the invention. Various modifications may be made by those skilled in the art consistent with the principles set forth hereinbefore.

We claim:

1. A method for qualifying a semiconductor manufacturing tool comprising a bulk removal polishing platen, a copper clearing platen and a barrier removal polishing platen, said method comprising:

(a) transferring a wafer to said bulk removal polishing platen;

(b) measuring, in situ, bulk removal polishing platen qualification characteristics from said wafer during processing by said bulk removal polishing platen;

(c) qualifying said bulk removal polishing platen by adjusting one or more parameters of a process recipe in accordance with said one or more bulk removal polishing platen qualification characteristics measured from said wafer to target one or more bulk removal polishing platen specifications;

(d) transferring a wafer to said copper clearing platen;

(e) measuring, in situ, copper clearing platen qualification characteristics from said wafer during processing by said copper clearing platen;

(f) qualifying said copper clearing platen by adjusting one or more parameters of said recipe revised in (c) in accordance with said one or more copper clearing platen qualification characteristics measured from said wafer to target one or more copper clearing platen specifications;

(g) transferring a wafer to said barrier removal polishing platen;

(h) measuring, in situ, barrier removal polishing platen qualification characteristics from said wafer during processing by said barrier removal polishing platen;

(i) qualifying said barrier removal polishing platen by adjusting one or more parameters of said recipe revised in (f) in accordance with said one or more barrier removal polishing platen qualification characteristics to target one or more barrier removal polishing platen specifications;

(j) using said recipe revised in (i) in the processing of one or more subsequent wafers by each of said bulk removal polishing platen, said copper clearing platen, and said barrier removal polishing platen;

(k) measuring, in situ, a defectivity from said wafer; and (l) qualifying said tool for defectivity by adjusting one or more parameters of said recipe in accordance with said defectivity to target a defectivity specification.

2. The method of claim 1, wherein said bulk removal polishing platen is qualified by adjusting one or more parameters of a first recipe;

wherein said copper clearing platen is qualified by adjusting one or more parameters of a second recipe;

wherein said barrier removal polishing platen, is qualified by adjusting one or more parameters of a third recipe; and wherein said first, second, and third recipes are distinct.

3. The method of claim 1, wherein steps (a)-(j) are performed periodically.

4. A method for qualifying a semiconductor manufacturing tool comprising a set of polishing and clearing platens, said method comprising:

(a) processing a wafer with the set of platens of said manufacturing tool;

(b) measuring, in situ, from said wafer, during processing by each of the set of platens of said manufacturing tool, one or more qualification characteristics of each of the set of platens, wherein said one or more qualification characteristics include a defectivity;

(c) after measuring qualification characteristics of one of the set of platens, qualifying the one of the set of platens of said manufacturing tool by adjusting one or more parameters of a process recipe in accordance with said one or more qualification characteristics measured from said wafer to target one or more specifications of the one of the set of platens;

(d) repeating the adjustment of parameters of the recipe while qualifying each other of the set of platens, to provide a final recipe; and (e) using said final recipe in the processing of one or more subsequent wafers by each of the set of platens of said manufacturing tool.

5. The method of claim 4, wherein said manufacturing tool comprises a chemical planarization tool, which further comprises a bulk copper removal polishing platen, and wherein said one or more qualification parameters are measured during processing by said bulk copper removal polishing platen.

6. The method of claim 4, wherein said manufacturing tool comprises a chemical planarization tool, which further comprises a copper clearing platen, and wherein said one or more qualification parameters are measured during processing by said copper clearing platen.

7. The method of claim 4, wherein said manufacturing tool comprises a chemical planarization tool, which further comprises a barrier removal polishing platen, and wherein said one or more qualification parameters are measured during processing by said barrier removal polishing platen.

8. The method of claim 4, wherein said manufacturing tool comprises a chemical planarization tool, which further comprises a bulk copper removal polishing platen and a copper clearing platen, and wherein said one or more qualification parameters are measured during processing by said bulk copper removal polishing platen and said copper clearing platen.

9. The method of claim 4, wherein said manufacturing tool comprises a chemical planarization tool, which further comprises a copper clearing platen and a barrier removal polishing platen, and wherein said one or more qualification parameters are measured during processing by said copper clearing platen and said barrier removal polishing platen.

10. The method of claim 4, wherein said manufacturing tool comprises a chemical planarization tool, which further comprises a bulk copper removal polishing platen, a copper clearing platen, and a barrier removal polishing platen, and wherein said one or more qualification parameters are measured during processing by said bulk copper removal polishing platen, said copper clearing platen, and said barrier removal polishing platen.

11. The method of claim 4, wherein said measuring comprises measuring using an in situ eddy current measuring sensor implemented at a bulk removal polishing platen of said manufacturing tool.

12. The method of claim 4, wherein said measuring comprises measuring using an in situ laser interferometer implemented at a copper clearing platen of said manufacturing tool.

13. The method of claim 4, wherein said measuring comprises measuring using an in situ optical sensor implemented at a barrier removal polishing platen of said manufacturing tool.

14. The method of claim 4, where said one or more qualification characteristics comprises a polishing rate.

15. The method of claim 4, where said one or more qualification characteristics comprises a nonuniformity.

16. The method of claim 4, wherein said wafer comprises a single patterned wafer.

17. The method of claim 16, wherein all of said one or more qualification characteristics required to properly qualify said tool are measured from said single patterned wafer.

18. The method of claim 4, wherein said tool is properly qualified using qualification characteristics measured only from said wafer.

19. A semiconductor manufacturing tool including a set of polishing and clearing platens, the tool comprising:

a processing module at each of the set of platens capable of processing a wafer;

an in situ metrology device at each of the set of platens capable of measuring from said wafer, during processing by each of the set of platens, one or more qualification characteristics of each of the set of platens, wherein said one or more qualification characteristics include a defectivity; and a controller at each of the set of platens capable of qualifying said each of the set of platens by adjusting one or more parameters of a process recipe in accordance with said one or more qualification characteristics measured from said wafer to target one or more specifications of corresponding platens, wherein a resulting recipe is used in the processing of one or more subsequent wafers by each of the set of platens of said manufacturing tool.

20. The tool of claim 19, wherein said manufacturing tool comprises a chemical planarization tool, wherein said processing module comprises a bulk copper removal polishing platen, and wherein said one or more qualification parameters are measured during processing by said bulk copper removal polishing platen.

21. The tool of claim 19, wherein said manufacturing tool comprises a chemical planarization tool, wherein said processing module comprises a copper clearing platen, and wherein said one or more qualification parameters are measured during processing by said copper clearing platen.

22. The tool of claim 19, wherein said manufacturing tool comprises a chemical planarization tool, wherein said processing module comprises a barrier removal polishing platen, and wherein said one or more qualification parameters are measured during processing by said barrier removal polishing platen.

23. The tool of claim 19, wherein said in situ metrology device comprises an in situ eddy current measuring sensor implemented at a bulk removal polishing platen of said manufacturing tool.

24. The tool of claim 19, wherein said in situ metrology device comprises an in situ laser interferometer implemented at a copper clearing platen of said manufacturing tool.

25. The tool of claim 19, wherein said in situ metrology device comprises an in situ optical sensor implemented at a barrier removal polishing platen of said manufacturing tool.

26. The tool of claim 19, where said one or more qualification characteristics comprises a polishing rate.

27. The tool of claim 19, where said one or more qualification characteristics comprises a nonuniformity.

28. A system for qualifying a semiconductor manufacturing tool comprising a set of polishing and clearing platens, said system comprising:

means for processing a wafer with the set of platens of said manufacturing tool;

means for measuring, in situ, from said wafer, during processing by each of the set of platens of said manufacturing tool, one or more qualification characteristics of each of the set of platens, wherein said one or more qualification characteristics include a defectivity;

means for, after measuring qualification characteristics of one of the set of platens, qualifying the one of the set of platens of said manufacturing tool by adjusting one or more parameters of a process recipe in accordance with said one or more qualification characteristics measured from said wafer to target one or more specifications of the one of the set of platens; and means for repeating the adjustment of parameters of the recipe while qualifying each other of the set of platens, to provide a final recipe, wherein said final recipe is used in the processing of one or more subsequent wafers by each of the set of platens of said manufacturing tool.

29. The system of claim 28, wherein said means for measuring comprises means for measuring using an in situ eddy current measuring sensor implemented at a bulk removal polishing platen of said manufacturing tool.

30. The system of claim 28, wherein said means for measuring comprises means for measuring using an in situ laser interferometer implemented at a copper clearing platen of said manufacturing tool.

31. The system of claim 28, wherein said means for measuring comprises means for measuring using an in situ optical sensor implemented at a barrier removal polishing platen of said manufacturing tool.

32. The system of claim 28, where said one or more qualification characteristics comprises a polishing rate.

33. The system of claim 28, where said one or more qualification characteristics comprises a nonuniformity.

34. A computer readable medium for qualifying a semiconductor manufacturing tool comprising a set of polishing and clearing platens, said computer readable medium comprising:

computer readable instructions for processing a wafer with the set of platens of said manufacturing tool;

computer readable instructions for measuring, in situ, from said wafer, during processing by each of the set of platens of said manufacturing tool, one or more qualification characteristics of each of the set of platens, wherein said one or more qualification characteristics include a defectivity;

computer readable instructions for, after measuring qualification characteristics of one of the set of platens, qualifying the one of the set of platens of said manufacturing tool by adjusting one or more parameters of a process recipe in accordance with said one or more qualification characteristics measured from said wafer to target one or more specifications of the one of the set of platens; and computer readable instructions for repeating the adjustment of parameters of the recipe while qualifying each other of the set of platens, to provide a final recipe, wherein said final recipe is used in the processing of one or more subsequent wafers by each of the set of platens of said manufacturing tool.

35. The computer readable medium of claim 34, wherein said computer readable instructions for measuring comprises computer readable instructions for measuring using an in situ eddy current measuring sensor implemented at a bulk removal polishing platen of said manufacturing tool.

36. The computer readable medium of claim 34, wherein said computer readable instructions for measuring comprises computer readable instructions for measuring using an in situ laser interferometer implemented at a copper clearing platen of said manufacturing tool.

37. The computer readable medium of claim 34, wherein said computer readable instructions for measuring comprises computer readable instructions for measuring using an in situ optical sensor implemented at a barrier removal polishing platen of said manufacturing tool.

38. The computer readable medium of claim 34, where said one or more qualification characteristics comprises a polishing rate.

39. The computer readable medium of claim 36, where said one or more qualification characteristics comprises a nonuniformity.

* * * * *